United States Patent [19]

Holland

[11] 4,020,477

[45] Apr. 26, 1977

[54] RADIO CENTRAL STATION ALARM SYSTEM

[75] Inventor: John M. Holland, Shawsville, Va.

[73] Assignee: American District Telegraph Company, New York, N.Y.

[22] Filed: Nov. 10, 1975

[21] Appl. No.: 630,547

[52] U.S. Cl. ..... 340/224; 340/167 R; 340/150; 340/413; 325/58; 178/69.1

[51] Int. Cl.[2] ..... G08B 1/08

[58] Field of Search ..... 340/224, 151, 167 R, 340/167 A, 408, 409, 413, 152 R, 152 T; 325/31, 53, 58; 178/53, 69.5 R; 179/15 BS

[56] References Cited

UNITED STATES PATENTS

| | | | |
|---|---|---|---|
| 2,234,598 | 3/1941 | Howton | 340/224 |
| 2,250,828 | 7/1941 | Foss | 340/276 |
| 2,250,834 | 7/1941 | Howton | 340/276 |
| 2,289,517 | 7/1942 | Muehter | 340/295 |
| 2,355,395 | 8/1944 | Rubenstein | 340/258 |
| 2,700,152 | 1/1955 | Jones et al. | 340/224 |
| 3,559,195 | 1/1971 | Dotto | 340/224 |
| 3,568,154 | 3/1971 | Sills | 340/167 |
| 3,609,739 | 9/1971 | Walter | 340/274 |
| 3,611,361 | 10/1971 | Gallichotte | 340/408 |
| 3,689,888 | 9/1972 | Wooton | 340/164 R |
| 3,713,142 | 1/1973 | Getchell | 340/152 T |
| 3,720,911 | 3/1973 | Bomar, Jr. | 340/52 F |
| 3,757,315 | 9/1973 | Birchfield et al. | 340/224 |
| 3,848,231 | 11/1974 | Wooton | 340/164 R |
| 3,852,740 | 12/1974 | Haymes | 340/416 |
| 3,872,437 | 3/1975 | Cross | 179/15 BS |
| 3,909.826 | 9/1975 | Schidmeier et al. | 340/412 |

OTHER PUBLICATIONS

Gibson et al., "Monitoring Remote Utility Sites With Radio", June, 1975, pp. 12–15.

Bennett et al., "Data Transmission", 1965, pp. 26–31.

Albert, "Electrical Communication", Apr., 1959, pp. 530–531.

ADT Bulletin, "McCulloh Circuit Operation", pp. 1–8, Aug., 1961.

*Primary Examiner*—John W. Caldwell

*Assistant Examiner*—Donnie L. Crosland

*Attorney, Agent, or Firm*—Charles B. Smith; Robert R. Jackson

[57] ABSTRACT

A radio central station alarm system including a central station and a plurality of remote stations for transmitting alarm signals to the central station by means of radio signals. Alarm signals are transmitted repeatedly in a sequence which reduces the probability that signals transmitted by one remote station will be completely obscured by signals transmitted by other remote stations. A pulse position modulation binary data format is used which simplifies both remote and central station apparatus and facilitates error-free data transmission. The central station is highly immune to noise and performs a number of tests on received data signals to reduce or eliminate false or erroneous alarm indications. Latching alarm sensor circuits are provided for use at the remote stations to insure that all transmission sequences are completed. Protective circuits are provided for disabling any remote station which transmits signals for longer than a maximum allowable transmission interval.

15 Claims, 12 Drawing Figures

1s
3s
APPROX. 60s 3 2 1 0 3 2 1 0 3 2 1 0 3 2 1 0 3 2 1 0 3 2 1 0

1ms

3ms
2ms
1ms
F
1 0 0 0 0 1 0 0 0 0 1 0 0 1 1 1
FRAME
REMOTE STATION NUMBER
421
ALARM CONDITION
0
RECEIVER ACCESS CODE
3

RADIO CENTRAL STATION ALARM SYSTEM

BACKGROUND OF THE INVENTION

This invention relates to central station alarm systems, and more particularly to central station alarm systems in which alarm signals are transmitted from one or more remote stations to a central station by radio signals. connected A typical central station alarm system includes a central station and a plurality of remote stations for transmitting alarm signals to the central station. Each remote station monitors one or more possible alarm conditions (e.g., smoke, fire, unauthorized entry, refrigeration loss, etc.) at the location of the remote station and produces an output signal identifying the remote station and type of alarm condition when an alarm condition occurs. The central station receives and decodes the signals transmitted by the remote stations and initiates action appropriate to the alarm conditions which are occurring. For example, the central station may alert the operator of the system to the occurrence of an alarm condition by displaying information which identifies the remote station signaling the alarm condition and the type of alarm condition detected by that remote station.

Although referred to for convenience herein as central station alarm systems, systems of this same type may be used for monitoring conditions of any kind at remote locations. For example, pressures at a number of points throughout a pipeline system can be monitored using this type of system. The proper functioning of remotely located automatic oil or other wells can be similarly monitored with this type of system. Many other similar applications will occur to those familiar with such systems.

The remote stations may be connected to the central station via leased (e.g., telephone) or private wire connections. In many areas, however, wire connections are unavailable, unreliable, or uneconomical. In remote or relatively undeveloped areas, telephone wires may not be available and it may be uneconomical to run wires just for an alarm system. Similarly, in highly congested urban areas, spare telephone wires may not be available and the cost of running additional wires may be prohibitive. There are also many areas where telephone or other existing wire communications networks are not sufficiently reliable for use in transmitting alarm signal information, and again the cost of installing private wire connections may be prohibitive. There has therefore been increasing interest in central station alarm systems in which the alarm signals are transmitted to the central station by radio communication.

In a typical radio central station alarm system, a remote station which detects an alarm condition broadcasts a radio frequency signal identifying the remote station and the type of alarm condition occurring at that remote station. A central station located within range of the remote station receives the radio signal and determines the identify of the remote station and type of alarm condition causing that signal to be transmitted. All of the remote stations in a particular area usually operate on the same frequencies. This is done to conserve band space and may in addition be required by official regulations. This also makes it possible to construct central station receivers which are responsive to a relatively narrow band of radio frequencies, as is usually desirable for economic reasons and to minimize noise and other interference. However, this also means that the central station may receive signals from two or more remote stations simultaneously. It is therefore necessary to provide a system in which the probability that signals transmitted by one remote station will be completely obscured by signals transmitted by other remote stations is acceptably low. It is also necessary to provide a system which does not respond to mixed signals from two or more remote stations to produce erroneous alarm indications. It is also desirable to insure that no remote station can transmit continuously for extended periods of time and thereby obscure signals transmitted by other remote stations.

To minimize the possibility of false or erroneous alarm indications, it is desirable to use a simple format for the alarm signals, i.e., a format in which information can be accurately and reliably encoded and decoded. It is also desirable for each remote station to transmit each alarm signal a number of times to insure that the signal is correctly received. These signals are preferably transmitted during several spaced time intervals to reduce the probability that they will be completely obscured by other alarm signals, Since noise may be present on the frequencies used by the system, it is desirable that the system have a high immunity to noise.

In view of the foregoing, it is an object of this invention to improve and simplify radio central station alarm systems.

It is a more particular object to provide improved remote station transmitter apparatus for use in radio central station alarm systems.

It is another more particular object of this invention to provide improved central station receiver apparatus for use in radio central station alarm systems.

SUMMARY OF THE INVENTION

These and other objects of the invention are accomplished in accordance with the principles of the invention by providing a radio central station alarm system including remote station transmitters, each of which monitors a plurality of alarm conditions and, when an alarm condition occurs, repeatedly generates binary data words identifying the remote station and each of the several possible alarm conditions in turn. The data word corresponding to each alarm condition is generated repeatedly during each of several spaced time intervals. Each data word includes a plurality of binary digits (bits) represented by position modulated timing signal pulses. A bit having a first binary value (e.g., binary 0) is represented by a timing pulse occurring a first predetermined time interval after the preceding timing pulse, and a bit having a second binary value (e.g., binary 1) is represented by a timing pulse occurring a second predetermined time interval after the preceding timing pulse. Binary 0 signals are generated by passing successive regularly occurring timing pulses produced by an oscillator or clock circuit. A binary 1 signal is generated by suppressing one timing pulse produced by the clock and passing the next timing pulse produced by the clock. Data words are separated from one another by a frame pulse which is produced by suppressing two successive timing pulses produced by the clock and passing the next timing pulse produced by the clock.

When any alarm condition occurs at a remote station, the remote station repeatedly samples the alarm output signals of each of a plurality of alarm sensor circuits in turn for a predetermined time interval. For example, if there are four alarm sensor circuits associated with a remote station, the remote station may sample the output signal of each alarm sensor in turn eight times for intervals of approximately 1 second each. A substantial delay (e.g., approximately 1 minute) may be provided, for example, in the middle of this sampling sequence. While each alarm sensor output signal is being sampled, the remote station repeatedly generates a data word identifying the remote station and the alarm sensor being sampled. The resulting data output signal is used to modulate a radio frequency signal. For example, the radio frequency signal may be frequency shift modulated. The modulated radio frequency signal is transmitted only while an alarm sensor having an output signal indicating the occurrence of an alarm condition is being sampled.

One or more bits of each data word generated by a remote station may represent the code number of one of several central stations within the range of the remote station which is to respond to signals transmitted by that remote station. Other central stations receiving those signals do not respond to them. This permits a greater number of remote stations to operate on the same frequencies in the same area than could be accommodated by one central station.

The central station receiver provided in accordance with the principles of this invention receives and demodulates the radio frequency signals transmitted by the remote stations to produce a data signal including timing pulses corresponding to the timing pulses in the data signals generated by the remote stations. The central station decodes this data signal by looking for timing pulses in the data signal at appropriate times following each successive timing pulse corresponding to the transmission of binary 0, binary 1, or a frame pulse. This is accomplished by means of a shift register which is preset after each timing pulse is received and which shifts at a predetermined rate thereafter. If the next timing pulse is received when the shift register has shifted a first predetermined number of times to apply an output signal to a first output terminal, a binary 0 has been transmitted and a binary 0 is therefore stored in a data shift register. If the next timing pulse is received when the shift register has shifted a second greater predetermined number of times to apply an output signal to a second output terminal, a binary 1 has been transmitted and a binary 1 is therefore stored in the data shift register. If the next timing pulse is received when the shift register has shifted a third still greater predetermined number of times to apply an output signal to a third output terminal, a frame pulse has been transmitted.

While the shift register applies an output signal to output terminals before the first output terminal, intermediate the first and second output terminals, and intermediate the second and third output terminals, the apparatus is rendered unresponsive to timing pulses in the received data signal to exclude or blank any such pulses caused by noise, etc. If the shift register shifts beyond the third output terminal before the next timing pulse is received, an error detector circuit is set. Each data bit decoded is compared to the corresponding bit in the previously decoded data word stored in the data shift register. If any bit does not match the corresponding bit in the previously received data word, the error detector circuit is set. A counter is provided for counting each timing pulse to which the decoder responds.

When a frame pulse is received, a control transfer signal is produced if the counter contains a count correspond to the number of bits in a data word and if the error circuit is not set. The central station must therefore receive two successive identical data words before the control transfer signal is produced. Both the counter and the error circuit are reset after each frame pulse is received. The control transfer signal indicates that a valid alarm data word is in the data shift register. This data word is then decoded or otherwise processed to produce an output alarm indication of the remote station and alarm condition represented by that data word. Means can be provided for storing a plurality of previously received data words and for comparing each new data word to the previously received data words so that data words already received are not processed again. If the data words include one or more bits representing the code number of a receiver which is to respond to particular data words, means are provided for suppressing the control transfer signal unless the data word stored in the data shift register includes bits representing the code number of the central station.

Latching alarm sensors for use in conjunction with the remote stations of this invention can also be constructed in accordance with the principles of this invention. These alarm sensors latch when triggered by the occurrence of an alarm condition and therefore continue to produce an alarm output signal until reset by an appropriate signal from the remote station apparatus.

In order to prevent a malfunctioning remote station from possibly transmitting for longer than a maximum allowable transmission interval and thereby possibly obscuring signals transmitted by other remote stations, each remote station may include a timing circuit in accordance with the principles of this invention for timing each transmission interval of the remote station and disabling the remote station if a transmission interval exceeds the maximum allowable transmission interval.

Further features of the invention, its nature and various advantages will be more apparent from the accompanying drawing and the following detailed description of the invention.

Figure 1:
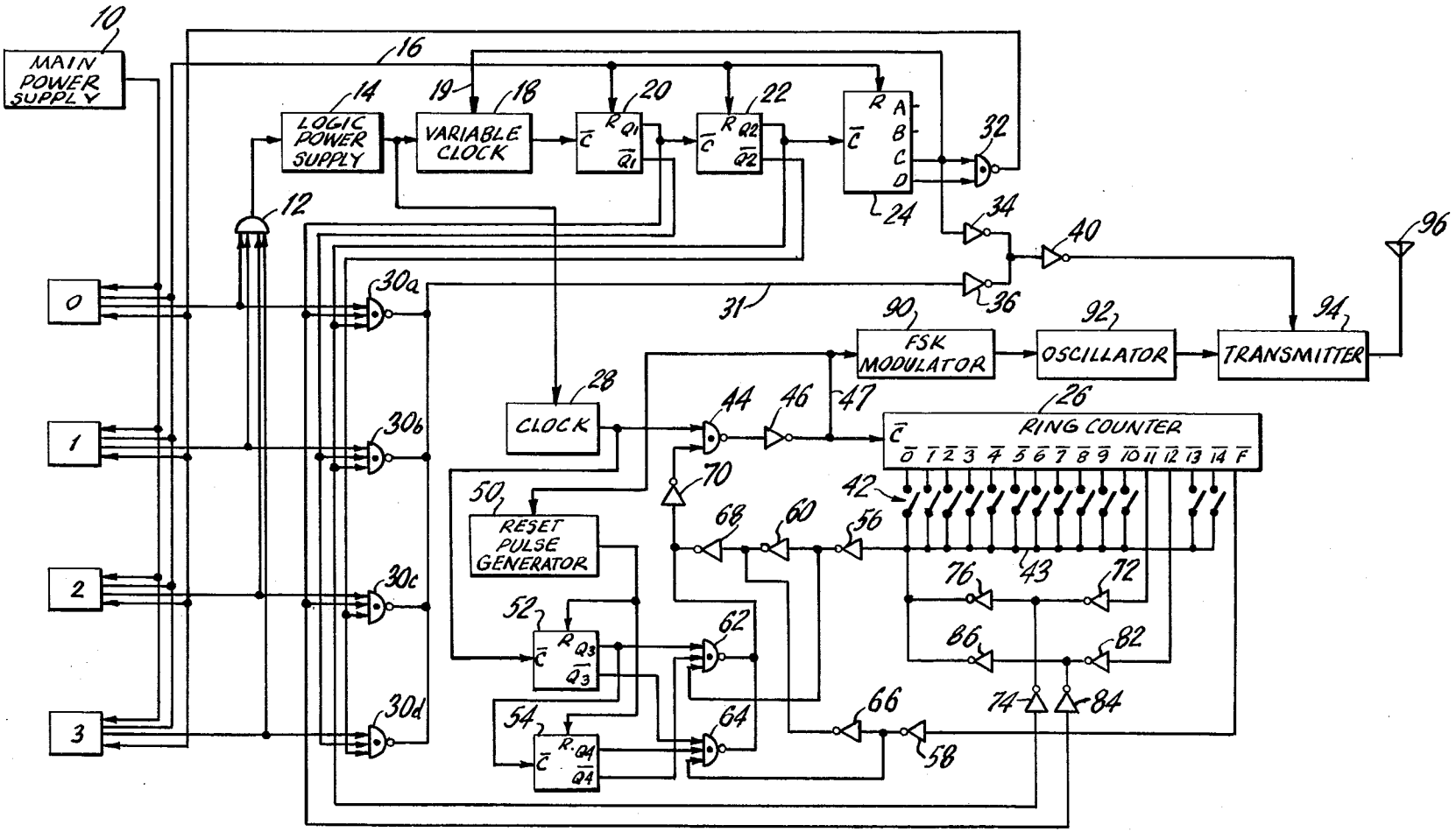
FIG. 1 is a schematic block diagram showing a remote station constructed in accordance with the principles of this invention.
Figure 4:
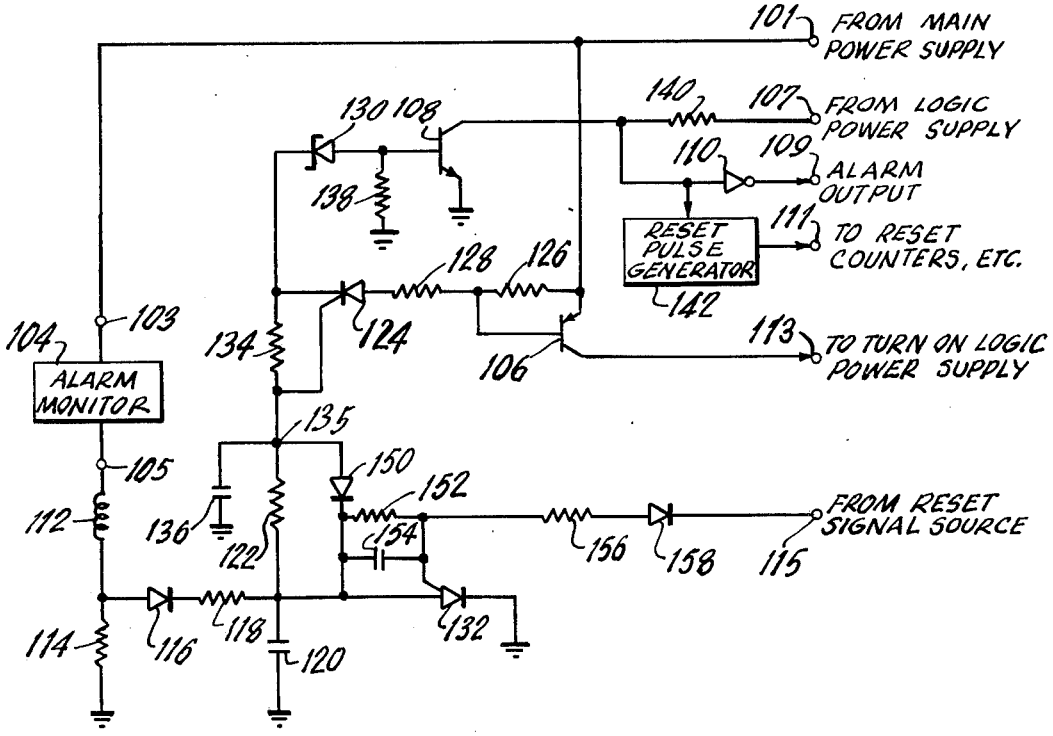
Figure 5:
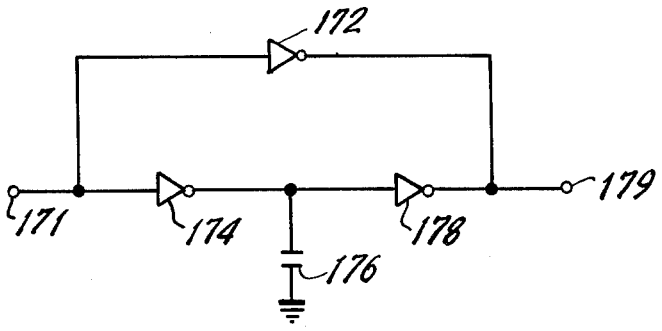
Figure 6:
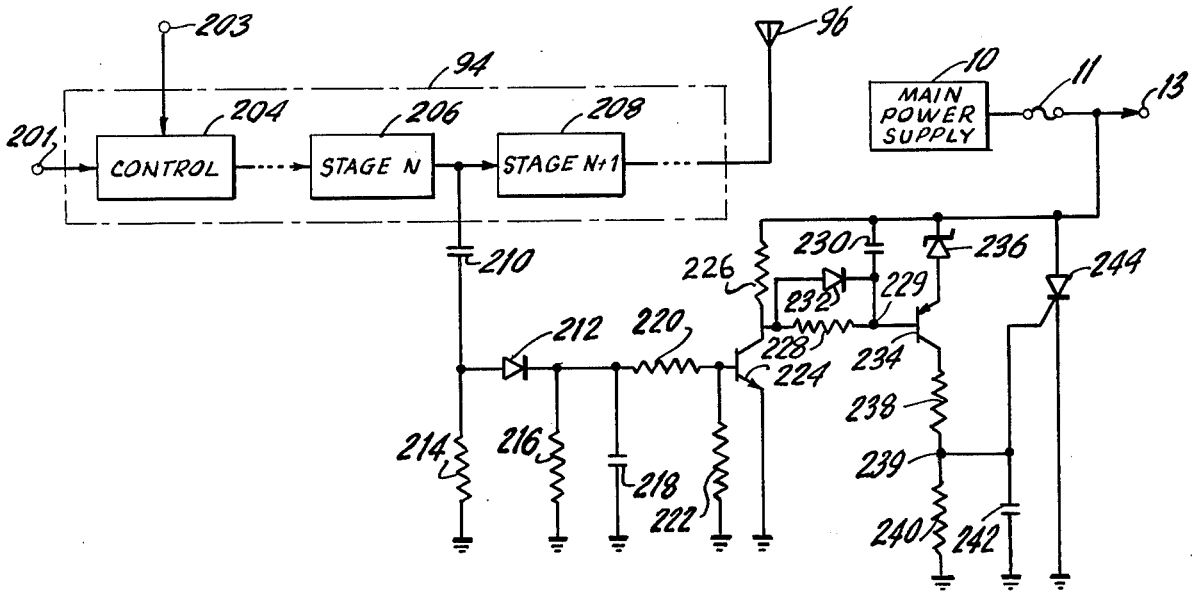
Figure 8:
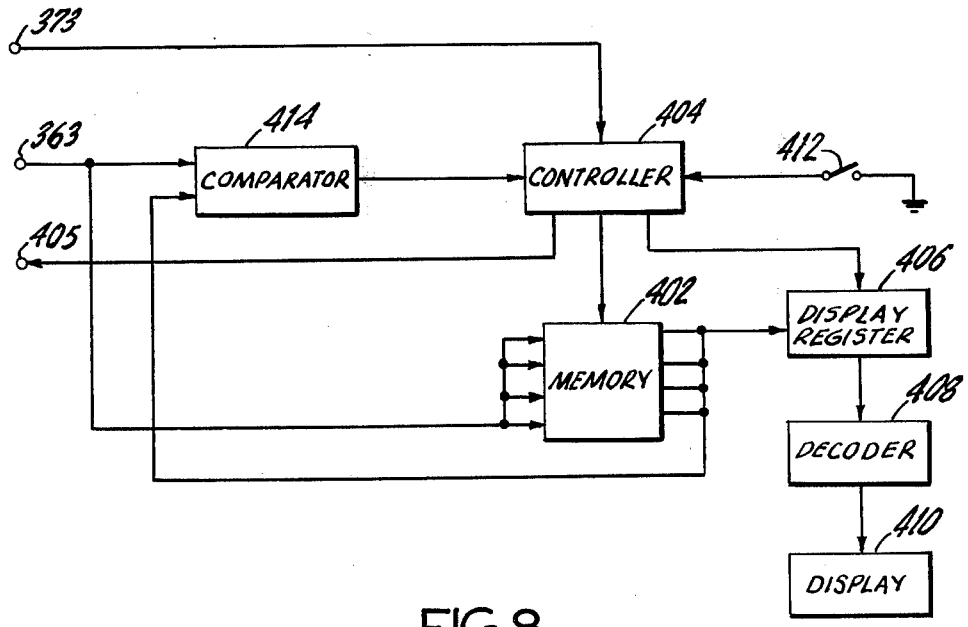
Figure 7:
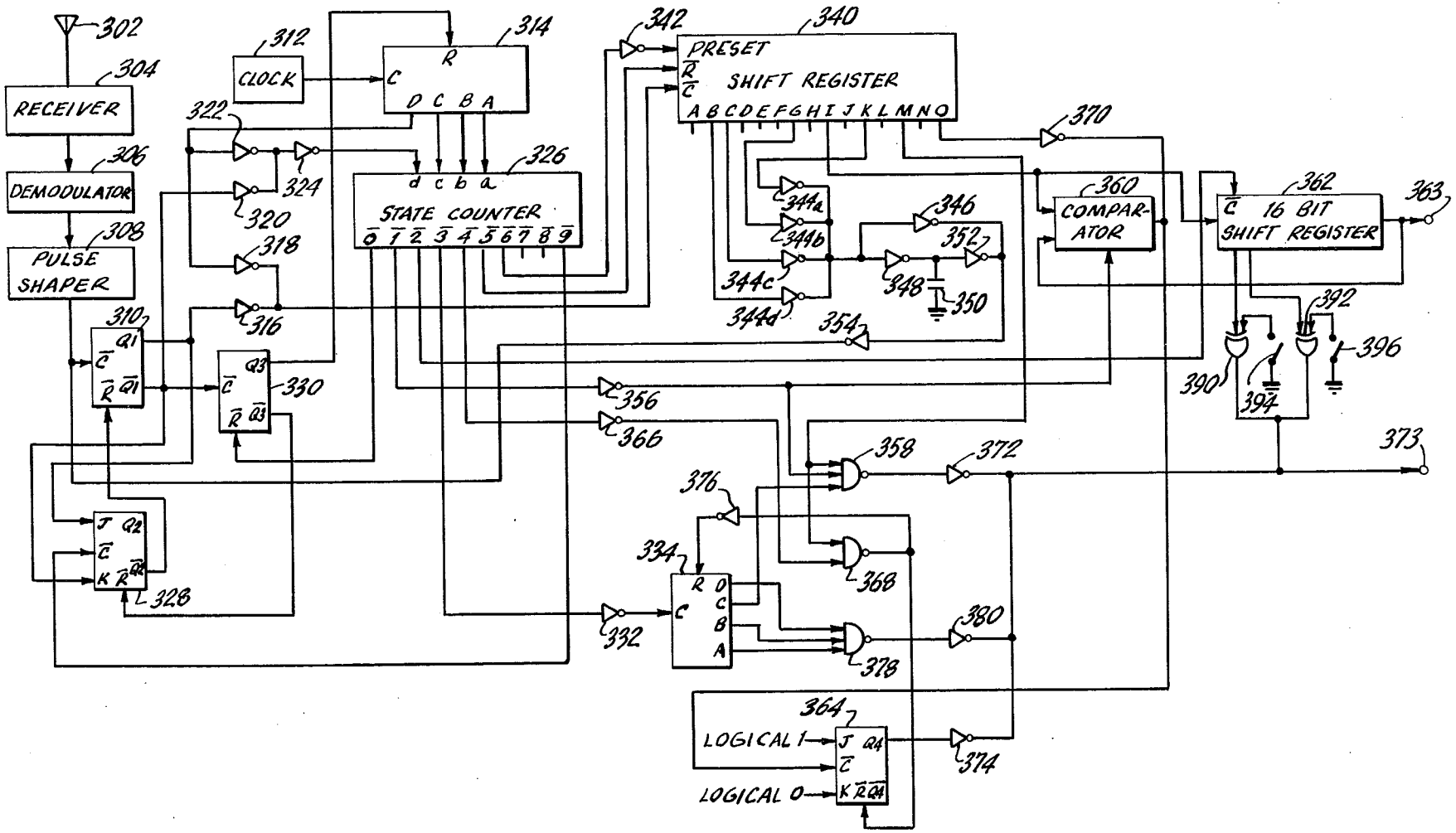

FIGS. *2a–d* illustrate several possible alarm signal transmission sequences produced by the remote station of FIG. 1;

FIG. *3a* illustrates a timing signal generated in the remote station of FIG. 1, and FIG. *3b* illustrates a typical pulse position modulated data word produced by the remote station of FIG. 1;

FIG. 4 is a schematic block diagram showing a latching alarm sensor circuit constructed in accordance with the principles of this invention for use in the remote station of FIG. 1;

FIG. 5 is a schematic diagram showing a reset pulse generator circuit for use in either the apparatus of FIG. 1 or the apparatus of FIG. 4;

FIG. 6 is a schematic block diagram showing a timing circuit for use with the remote station of FIG. 1 to disable a remote station which is transmitting for longer than a maximum allowable transmission interval;

FIG. 7 is a schematic block diagram of central station apparatus constructed in accordance with the principles of this invention for receiving and decoding signals transmitted by the remote stations of this invention; and FIG. 8 is a schematic block diagram of further central station apparatus constructed in accordance with the principles of this invention for storing and displaying successive data words received by the apparatus of FIG. 7.

DESCRIPTION OF THE INVENTION

In the particular embodiment of the remote station transmitter apparatus of this invention shown in FIG. 1, the transmitter monitors as many as four alarm conditions by means of alarm sensors 0–3. When any of these alarm conditions occurs, the transmitter transmits data words identifying the remote station and the type of alarm condition which has occurred. In practice it may be desirable to use one of alarm sensors 0–3 (e.g., alarm sensor 0) to initiate transmission of signals which are interpreted to indicate that the transmitter is operating normally rather than that an alarm condition has occurred. In that event, means may be provided for periodically triggering the alarm sensor used for that purpose.

Figures 2A, 2B, 2C, 2D, 3A, 3B:
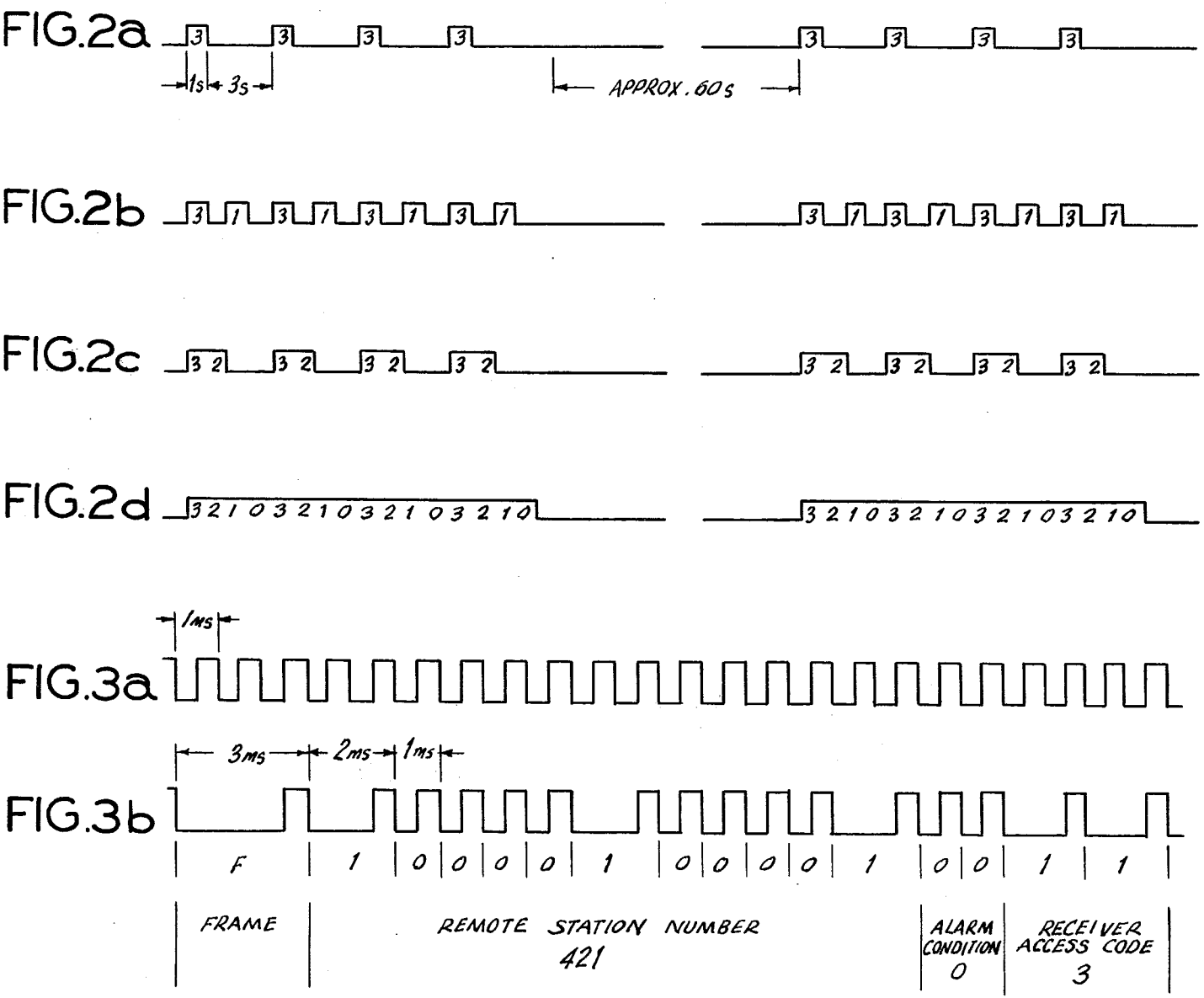

When an alarm condition occurs, the transmitter of FIG. 1 transmits the data words associated with each alarm condition which has occurred during eight successive transmission intervals of approximately 1 second each. The data word for a given alarm condition is transmitted many times during each one-second transmission interval. In the embodiment shown in the drawing, a data word may be transmitted 40 to 50 times during each one-second transmission interval. The first four 1-second transmission intervals for each alarm condition are separated by intervals of approximately three seconds during which either nothing is transmitted or, if more than one alarm condition has occurred, data words associated with the other alarm conditions which have occurred are transmitted. Following the first four transmissions for each alarm condition which has occurred, there is a period for approximately 1 minute during which nothing is transmitted, and then the initial transmission sequence is repeated Several representative transmission sequences are shown in FIGS. 2*a–d*. In FIG. 2*a* only alarm condition 3 has occurred. Accordingly, there are four one-second transmissions of the data word indicating that alarm condition 3 has occurred, separated by intervals of three seconds during which nothing is transmitted. After the fourth one-second transmission of this data word, nothing is transmitted for approximately 60 seconds, and then the initial transmission sequence is repeated, i.e., there are four more 1-second transmissions of the data word for alarm condition 3 separated by intervals of three seconds during which nothing is transmitted. In FIG. 2*b* alarm conditions 3 and 1 have occurred. The data word for alarm condition 3 is transmitted for one second; then nothing is transmitted for one second; then the data word for alarm condition 1 is transmitted for 1 second; then nothing is again transmitted for one second; and then the data word for alarm condition 3 is transmitted again for 1 second. This sequence continues until there have been four transmissions for each of alarm conditions 3 and 1. Then nothing is transmitted for approximately one minute and the entire sequence is repeated again. In FIG. 2*c* alarm conditions 3 and 2 have occurred, and in FIG. 2*d* all four alarm conditions have occurred.

As is suggested by FIGS. 2*a–d*, when an alarm condition occurs, the output signals of alarm sensors 0–3 are repeatedly sampled in turn in reverse numerical order for intervals of approximately 1 second each, and if the output signal of an alarm sensor indicates that the alarm condition monitored by that sensor has occurred, the data word indicating the occurrence of that alarm condition is transmitted repeatedly while the output signal of the alarm sensor is being sampled. Alarm sensors 0–3 are preferably of the type which latch when triggered so that once an alarm condition has been detected, the transmitter can complete the transmission sequence described above even if the alarm condition should cease to be detected before that sequence is completed. At the end of the transmission sequence, the transmitter apparatus produces an output signal for resetting the alarm sensors. If a new alarm condition occurs at any time during the transmission sequence, the transmitter apparatus is reset and the transmission sequence begins again, adding transmissions of the data word for the new alarm condition.

Considering the transmitter apparatus shown in FIG. 1 in greater detail, the portion of that apparatus including elements 18, 20, 22, 24, and 30*a–d* samples the alarm output signals of alarm sensors 0–3 in turn when an alarm condition occurs; the portion including elements 26, 28, 50, 52, 54, and logic devices interconnecting those elements repeatedly generates data words indicating the occurrence of the alarm condition associated with the alarm sensor output signal currently being sampled; and the portion including elements 90, 92, 94, and 96 generates radio frequency signals representative of the data words thus produced and transmits those signals representing alarm conditions which have in fact occurred.

Power for alarm condition detection is supplied to each of sensors 0–3 from main power supply 10. Main power supply 10 may also supply power as required to other portions of the transmitter apparatus by other connections not shown in FIG. 1. For example, main power supply 10 may supply power to logic power supply 14 and to transmitter 94 for driving the several amplifier stages of that device. Main power supply 10 may be any suitable electrical power supply, for example, a battery charged by a charger connected to utility power lines (e.g., 110 volt power lines).

As long as none of the alarm conditions monitored by alarm sensors 0–3 occurs, the signals on the output leads of each alarm sensor remain at a low or logical 0 level. When any of alarm conditions 0–3 occurs, the alarm sensor detecting that alarm condition produces a reset pulse (i.e., a momentary logical 1 signal) on the output lead connected to lead 16, and substantially simultaneously the signal on the other output lead of that alarm sensor changes to a high or logical 1 level. Assuming that no other alarm condition has already occurred, the output signal of OR gate 12 changes from logical 0 to logical, 1, thereby turning on logic power supply 14 and starting clocks 18 and 28. Logic power supply 14 remains on as long as any of alarm sensors 0–3 are triggered. As mentioned above, once an alarm sensor is triggered, it remains triggered until the transmission sequence is completed and a reset signal is applied to the alarm sensors. In addition to supplying power to clocks 18 and 28, logic power supply 14 may supply power as required to other portions of the transmitter logic apparatus, for example, to enable that apparatus. The reset pulse applied to lead 16 when an alarm condition is first detected resets flip-flops 20 and 22 to the state in which Q1 and Q2 are logical 0 and $\overline{Q1}$ and $\overline{Q2}$ are logical 1. This reset pulse also resets binary counter 24 to zero so that the signal applied to each of counter output terminals A–D is logical 0.

The alarm output signal of each of sensors 0–3 is applied to a respective one of NAND gates 30*a–d*. When logic power supply 14 is turned on, varialbe clock 18 in conjunction with flip-flops 20 and 22 select NAND gates 30*a–d* in turn beginning with NAND gate 30*d*. Flip-flops 20 and 22 comprise a counter for counting the clock pulses produced by clock 18. Variable clock 18 has two speeds: a first relatively fast speed in which it produces an output clock pulse approximately once a second; and a second relatively slow speed in which it produces a clock pulse approximately once every 4 seconds. Variable clock 18 operates at its relatively fast speed when the signal applied to it by way of lead 19 is logical 1 and at its relatively slow speed when that signal is logical 0. Variable clock 18 may be a conventional timing signal generator having timing capacitance which can be varied (e.g., by selectively switching additional capacitance into the timing circuit) to vary the timing signal rate. Since binary counter 24 is initially reset to zero as mentioned above, the output signals at terminals C and D of binary counter 24 are initially logical 0 and the output signal of NAND gate 32 is initially logical 1. Variable clock 18 therefore operates initially at its relatively fast speed, producing a clock pulse approximately once a second.

After flip-flops 20 and 22 are initially reset and for approximately one second until the first clock pulse is produced by variable clock 18, NAND gate 30*d* is enabled by the logical 1 signals applied to its lower two input terminals from output terminals $\overline{Q1}$ and $\overline{Q2}$ of flip-flops 20 and 22. All of the rest of NAND gates 30 are disabled by having at least one logical 0 signal applied to their lower two input terminals. If alarm condition 3 has occurred, the signal applied to the remaining input terminal of NAND gate 30*d* is also logical 1 and the output signal of NAND gate 30*d* is logical 0. If any of the signals applied to NAND gate 30*d* is logical 0, the output signal of NAND gate 30*d* is logical 1.

When the first clock pulse from variable clock 18 occurs, flip-flop 20 changes state so that the signal applied to output terminal Q1 is logical 1 and the signal applied to output terminal $\overline{Q1}$ is logical 0. NAND gate 30d is accordingly disabled by the logical 0 signal applied to the middle one of its three input terminals and NAND gate 30*c* is enabled by the logical 1 signals applied to its two lower input terminals. NAND gates 30*a* and 30*b* remain disabled. If alarm condition 2 has occurred, the output signal of NAND gate 30*c* goes to logical 0. Otherwise, the output signal of NAND gate 30*c* remains logical 1.

When the second clock pulse is produced by variable clock 18, flip-flop 20 changes back to its initial state in which Q1 is logical 0 and $\overline{Q1}$ is logical 1. When Q1 changes from logical 1 to logical 0, flip-flop 22 changes state so that Q2 is logical 1 and $\overline{Q2}$ is logical 0. NAND gate 30*b* is accordingly enabled by the logical 1 signals applied to its two lower input terminals and the rest of NAND gates 30 are disabled. If alarm condition 1 has occurred, the output signal of NAND gate 30*b* goes to logical 0. Otherwise, the output signal of NAND gate 30*b* remains logical 1.

When the third clock pulse is produced by variable clock 18, flip-flop 20 again changes to the state in which Q1 is logical 1 and $\overline{Q1}$ is logical 0. The state of flip-flop 22 is unchanged. Accordingly, NAND gate 30*a* is enabled and the remainder of NAND gates 30 are disabled. If alarm condition 0 has occurred, the output signal of NAND gate 30*a* goes to logical 0. Otherwise it remains logical 1.

When the fourth clock pulse is produced by variable-clock 18, flip-flop 20 changes back to its initial state and the change in Q1 from logical 1 to logical 0 changes flip-flop 22 back to its initial state. Accordingly, NAND gate 30*d* is again enabled and the sequential selection of NAND gates 30 begins again. In addition, the change in Q2 from logical 1 to logical 0 advances the count of binary counter 24 by 1. Binary counter 24 is a four-plate binary counter having output terminals A-D respectively representing the zero through third powers of decimal 2. Binary counter 24 counts the cycles of the counter including flip-flops 20 and 22. Since binary counter 24 is initially reset to zero by the pulse on reset lead 16, the signal applied to output terminal C of counter 24 remains logical 0 until after each of NAND gates 30 has been selected by flip-flops 20 and 22 four times. During this time period, variable clock 18 operates at its relatively fast speed, producing a clock pulse approximately once a second. Accordingly, the alarm output signals of alarm sensors 0–3 are each sampled four times in turn for periods of 1 second each before the C output of binary counter 24 goes to logical 1 for the first time and variable clock 18 changes to its slow speed. The apparatus including flip-flops 20 and 22 therefore constitutes means for cyclically selecting each of alarm sensors 0–3 in turn when an alarm condition occurs. In addition, the Q1 and Q2 output signals of flip-flops 20 and 22 are respectively applied to inverters 84 and 74 to produce binary coded output signals identifying the selected alarm sensor.

While the signal applied to output terminal C of counter 24 is logical 0, the output signal of logical inverter 34 is logical 1. The signal level on lead 31 is high or logical 1 unless the output signal of any of NAND gates 30 is logical 0. While the signal on lead 31 is logical 1, the output signal of logical inverter 36 is logical 0 and when the signal on lead 31 is logical 0, the output signal of inverter 36 is logical 1. The signal applied to logical inverter 40 is logical 1 unless the output signal of either or both of inverters 34 and 36 is logical 0. The output signal of inverter 40 is logical 0 when the signal applied to it is logical 1, and that output signal is logical 1 otherwise. Transmitter 94 operates to transmit the output signal of oscillator 92 only when the output signal of inverter 40 is logical 0. This occurs only when the C output signal of counter 24 is logical 0 and a NAND gate 30 is selected which corresponds to an alarm condition which has occurred. During the initial period when the C output of counter 24 is logical 0, transmitter 94 therefore operates for 1-second intervals corresponding to the selection of a NAND gate 30 associated with an alarm condition which has actually occurred. Transmitter 94 therefore operates to produce the initial portion of the transmission sequence discussed above and illustrated, for example, in FIG. 2*a–d.*

When the c output of counter 24 goes to logical 1, variable clock 18 begins to operate at its slow speed producing a clock pulse approximately once every 4 seconds. Flip-flops 20 and 22 continue to operate as before, but at the slower rate determined by variable clock 18. Nothing is transmitted by transmitter, 94, however, because of C output of counter 24 keeps the output signal of inverter 40 logical 1. When 16 clock pulses have been produced by variable clock 18 at the slow speed, the C output of counter 24 again goes to logical 0 and the D output of counter 24 goes to logical 1 for the first time. Accordingly, variable clock 18 changes back to its fast speed and NAND gates 30 are again selected in turn for periods of 1 second each. In addition, transmitter 94 is again enabled each time a NAND gate 30 associated with a triggered alarm sensor is selected. Accordingly, the initial portion of the transmission sequence is repeated to produce the final portion of the transmission sequence. Since approximately one minute is required for variable clock 18 to produce 16 clock pulses at its slow speed, the C output of counter 24 is logical 1 and transmitter 94 is prevented from operating for approximately 1 minute between the initial and final portions of the transmission sequence.

When variable clock 18 has produced another 16 clock pulses at its fast speed, the C output of counter 24 goes to logical 1 again. Now, both the C and D output terminals of counter 24 are logical 1. Accordingly, the output signal of NAND gate 32 goes to logical 0 for the first time. This signal resets all of alarm sensors 0–3, causing all of the alarm output signals to go to logical 0 and turning off logic power supply 14.

As mentioned above, the portion of the apparatus including elements 26, 28, 50, 52, 54, and interconnecting logic elements repeatedly generates data words corresponding to the alarm sensor output signal currently being tested or sampled as described in detail above. Each of these data words includes 15 binary digits (bits) and a frame pulse indicating the end of one data word and the start of the next word. The first 11 bits in each word identify the remote station transmitting the information; the next 2 bits identify the alarm sensor output signal currently being tested; and the last 2 bits represent the receiver access code for the remote station transmitting the information (i.e., the code number of the one of as many as four central station receivers operating within range of the transmitter which is to respond to signals transmitted by the transmitter). The data words produced by this apparatus are pulse position modulated data words. The basic clock rate of this data is established by clock 28 which may operate, for example, at 1KHz, producing a square-wave output signal having a duty cycle of 50 percent as shown in FIG. 3*a*.

A typical data word produced by the apparatus of FIG. 1 is shown in FIG. 3*b*. Binary zercs are represented in this data word by the presence of all the high or logical 1 clock pulses produced by clock 28. A binary 1 is represented by the absence of one logical 1 clock pulse between successive logical 1 clock pulses, and a frame pulse is represented by the absence of two logical 1 clock pulses between successive logical 1 pulses. Accordingly, a binary 0 is represented by a data output signal which is logical 0 for 0.5 milliseconds followed by a logical 1 pulse of 0.5 milliseconds; a binary 1 is represented by a data output signal which is logical 0 for 1.5 milliseconds followed by a logical 1 pulse of 0.5 milliseconds; and a frame pulse is represented by a data output signal which is logical 0 for 2.5 milliseconds followed by a logical 1 pulse of 0.5 milliseconds.

The particular data word shown is FIG. 3*b* represents the data F 100 0010 0001 00 11. The first group of three bits may represent the hundreds place of a three-place decimal remote station number. The next group of 4 bits may represent the 10 place of the remote station number, and the next group of 4 bits may represent the ores place of that number. The next group of two bits represents the alarm condition number (from 9 to 3), and the last group of two bits represents the receiver access code (from 0 to 3). The particular data word shown in FIG. 3*b* then represents remote station 421, alarm condition 0, and receiver access code 3.

Data words of the type described above are generated in the apparatus of FIG. 1 by allowing the output signal of clock 28 to pass to a data output lead 47 when a binary 0 is to be generated; by suppressing one logical 1 pulse in the output signal of clock 28 when a binary 1 is to be generated; and by suppressing two successive logical 1 pulses in the output signal of clock 28 when a frame pulse is to be generated. Gate means including NAND gate 44 are provided for passing the output signal of clock 28 to data output lead 47 when NAND gate 44 is enabled and for inhibiting the output signal of clock 28 when NAND gate 44 is not enabled. The apparatus including flip-flops 52 and 54 constitutes a counter for counting the logical 1 pulses produced by clock 28 which are not passed by NAND gate 44. The data bits are produced in the proper sequence by ring counter 26 which connects each of its 16 output terminals (designated $\overline{0}$–$\overline{14}$ and $\overline{F}$ in FIG. 1) to ground (logical 0) in turn in order from left to right as viewed in FIG. 1. Since the data word for each alarm condition is generated so many times in succession during each one-second alarm sensor sampling interval (e.g., 40–50 times), there is no need to reset ring counter 26 at any time. The 11 bits of the remote station number are determined by the settings of the 11 switches 42 respectively connected between output terminals $\overline{0}$–$\overline{10}$ of ring counter 26 and lead 43. These 11 switches 42 therefore constitute means for storing the 11 bits of the remote station number. A switch 42 is open to represent a binary 0 and closed to represent a binary 1 in the remote station number. Lead 43 is high or logical 1 unless connected to ground by ring counter 26 through a closed switch 42 or unless the output signal of one of inverters 76 and 86 is logical 0. binary 0 is encoded when lead 43 is logical 1 unless ring counter output terminal $\overline{F}$ if logical 0. A binary 1 is encoded when lead 443 is logical 0. Switches 42 can be manually set when the remote station is first installed to represent a remote station number which is unique within the range of the transmitter. Similarly, switches 42 connected between output terminals $\overline{13}$ and $\overline{14}$ of ring counter 26 and lead 43 are set to represent the 2 bits of the receiver access code for the remote station. These switches may also be set when the remote station is installed. The two bits representing the alarm sensor currently being monitored are generated when ring counter output terminals $\overline{11}$ and $\overline{12}$ are logical 0. For example, the first of these bits is generated when ring counter output terminal $\overline{11}$ is logical 0. The output signal of inverter 72 then goes to logical 1 and the signal applied to inverter 76 is logical 1 unless the output signal of inverter 74 is logical 0. Inverter 74 inverts the Q2 output of flip-flop 22 which represents the inverse of the more significant bit of the binary code for the alarm sensor currently being monitored. If the signal applied to inverter 76 is logical 1, the output signal of that device is logical 0 indicating that a binary 1 is to be encoded. Accordingly, the output signal of inverter 76 indicates the state of flip-flop 22 when ring counter output terminal $\overline{11}$ is connected to ground. The apparatus therefore encodes the more significant bit of the binary code for the alarm sensor currently being monitored. Elements 82, 84, and 86 function similarly to cause the less significant bit of the binary code for that alarm sensor (indicated by the state of flip-flop 20) to be coded when ring counter output terminal $\overline{12}$ is logical 0. The apparatus including ring counter 26 therefore constitutes data sequencing means for cyclically selecting each of the bits represented by the settings of switches 42 and the binary output signals representing the alarm sensor currently being sampled (i.e., the output signals of inverters 74 and 84) and for producing a frame pulse initiating output intermediate the selection of two of the preceding items of information.

At the trailing edge of each logical 1 pulse passed by inverter 46, ring counter 26 advances one step to the right as viewed in FIG. 1 and reset pulse generator 50 produces a reset pulse for resetting flip-flops 52 and 54 to the state in which Q3 and Q4 are logical 0. If the next item of information to be encoded in a binary 0, lead 43 is high or logical 1 so that the output signal of inverter 56 is logical 0 and NAND gate 62 is disabled. Ring counter output terminal $\overline{F}$ is logical 1 so that the output signal of inverter 58 is logical 0 and NAND gate 64 is also disabled. The output signals of inverters 60 and 66 are both logical 1 so that the output signal of inverter 68 is logical 0 and the output signal of inverter 70 is logical 1 which enables NAND gate 44. NAND gate 44 therefore passes the output signal of clock 28 in inverted form and this signal is reinverted by inverter 46 to produce the data output signal on lead 47 representative of a binary 0.

At the trailing edge of the logical 1 pulse produced by inverter 46 to encode a binary 0 as discussed above, ring counter 26 is advanced another step to the right and flip-flops 52 and 54 are again reset by reset pulse generator 50. If the next item of information to be encoded is a binary 1, NAND gate 44 is disabled until the counter including flip-flops 52 and 54 and NAND gate 62 cooperate to enable it after the next logical 1 clock pulse has been produced by clock 28. Accordingly, one logical 1 clock pulse is omitted in the data output signal produced by inverter 46 as is required to encode a binary 1.

When a binary 1 is to be encoded, lead 43 goes to logical 0 and the output signal of inverter 56 is logical 1. The output signal of inverter 60 is logical 0, the output signal of inverter 68 is logical 1 and the output signal of inverter 70 is logical 0. NAND gate 44 is therefore disabled and does not pass the next logical 1 clock pulse produced by clock 28. At the trailing edge of the next logical 1 clock pulse produced by clock 28, flip-flop 52 changes to the state in which Q3 is logical 1. Flip-flop 52 is not reset because this logical 1 pulse is not passed by NAND gate 44 and therefore does not appear in the data output signal produced by inverter 46. Ring counter 26 is similarly not advanced. Since the output signal of inverter 56 is still logical 1 and since $\overline{Q4}$ is still logical 1, the output signal of NAND gate 62 goes logical 0 when Q3 becomes logical 1. Accordingly, the signal applied to inverter 70 is now logical 0 and the output signal of that device becomes logical 1, thereby enabling NAND gate 44. NAND gate 44 therefore passes the next logical 1 clock pulse produced by clock 28 and that pulse appears in the data output signal produced by inverter 46. Since one logical 1 clock pulse produced by clock 28 has been omitted in the data output signal, a binary 1 has been encoded as required. At the trailing edge of the logical 1 pulse passes by inverter 46 to complete the coding of the binary 1, ring counter 26 is advanced to the next stage and reset pulse generator 50 produces an output signal which resets flip-flops 52 and 54.

When ring counter 26 advances to output terminal $\overline{F}$, the next item of information to be encoded is a frame pulse. NAND gate 44 is therefore disabled by the $\overline{F}$ output signal of ring counter 26 until the counter including flip-flops 52 and 54 and NAND gate 64 cooperate to enable it after the next two logical 1 clock pulses have been produced by clock 28. Accordingly, two logical 1 clock pulses are omitted in the data output signal produced by inverter 46 as is required to encode a frame pulse.

When a frame pulse is to be encoded, the signal applied to inverter 58 goes to logical 0. The output signal of inverter 58 is therefore logical 1, the output signal of inverter 66 is logical 0, output signal of inverter 68 is logical 1, and the output signal of inverter 70 is logical 0, thereby disabling NAND gate 44. At the trailing edge of the next logical 1 clock pulse produced by clock 28, flip-flop 52 changes to the state in which Q3 is logical 1, and at the trailing edge of the next logical 1 clock pulse produced by clock 28, flip-flop 52 changes back to the state in which Q3 ic logical 0 and flip-flop 54 changes to the state in which Q4 is logical 1. Neither of the two logical 1 clock pulses required before flip-flop 54 changes to the state in which Q4 is logical 1 are passed by NAND gate 44, so that neither of these logical 1 clock pulses appears in the data output signal produced by inverter 46. Accordingly, neither of these pulses causes ring counter 26 to advance or causes reset pulse generator 50 to produce a reset pulse. When Q4 becomes logical 1, $\overline{Q3}$ is logical 1 and the output signal of inverter 58 is still logical 1. The output signal of NAND gate 64 therefore becomes logical 0 for the first time, causing the output signal of inverter 70 to become logical 1 and enabling NAND gate 44. NAND gate 44 therefore passes the next logical 1 clock pulse produced by clock 28 and that logical 1 pulse appears in the data output signal produced by inverter 46. Since the two preceding logical 1 clock pulses did not appear in the data output signal, a frame pulse has been encoded as required. At the trailing edge of the logical 1 pulse passed by inverter 46 to complete the coding of a frame pulse, ring counter 26 is advanced to apply a logical 0 signal to output terminal $\overline{0}$ and reset pulse generator 50 produces an output signal which resets flip-flops 52 and 54.

Turning now to the portion of the transmitter apparatus of FIG. 1 which encodes the data output signal as a radio frequency signal and transmits that signal: when logic power supply 14 is turned on, oscillator 92 is turned on and begins to produce an alternating current (AC) output signal having the basic radio frequency to be transmitted by the apparatus. This signal is frequency shift modulated by frequency shift key (FSK) modulator 90 to encode the data output signal applied to FSK modulator from inverter 46 in a manner well known to those skilled in the art. For example, when the data output signal is logical 0, FSK modulator 90 may permit oscillator 92 to operate at the basic frequency, and when the data output signal is logical 1, FSK modulator 90 shifts the frequency of oscillator 92 by a predetermined amount. If, for example, the basic frequency of oscillator 92 is 27 MHz, FSK modulator 90 may shift the frequency of oscillator 92 by 500 Hz when the data output signal is logical 1.

Transmitter 94 amplifies the output signal of oscillator 92 when the control signal applied to it from inverter 40 is logical 0. Accordingly, transmitter 94 operates only when a triggered alarm sensor is being monitored and the C output of binary counter 24 is logical 0.

Thus although data words representing all possible alarm conditions are generated by the encoder apparatus, only those data words corresponding to alarm conditions which have actually occurred are transmitted in sequence discussed above and illustrated, for example, in FIGS. *2a–d*. The output signal of transmitter 94 is applied to antenna 96 for broadcast to the central station receiver apparatus described in detail below.

A typical alarm sensor for use in conjunction with the apparatus of FIG. 1 and constructed in accordance with the principles of this invention is shown in greater detail in FIG. 4. Power from main power supply 10 in FIG. 1 is applied to the alarm sensor via terminal 101. Assuming the alarm sensor to be initially untriggered, alarm monitor 104 is an open circuit and no current flows from terminal 103 to 105. In addition, transistors 106 and 108 are initially nonconducting so that logic power supply 14 in FIG. 1 is not turned on by the signal applied to terminal 113. Even if logic power supply 14 is turned on by another alarm sensor and a logic 1 signal is applied to an untriggered alarm sensor via terminal 107, inverter 110 applies a logical 0 signal to alarm output terminal 109 of the untriggered alarm sensor so that the alarm sensor does not indicate that the associated alarm condition has occurred.

When the alarm condition monitored by the alarm sensor occurs, alarm monitor 104 closes a circuit between terminals 103 and 105 and current flows from terminal 101 through alarm monitor 104, coil 112, and resistor 114 to ground. Alarm monitor 104 may be any conventional device for closing a circuit when an alarm condition such as fire, smoke, unauthorized entry, etc., occurs. Coil 112 is provided to protect the circuit against excessive power surges which may be caused by lightning, etc. The current flowing through alarm monitor 104 begins to charge timing capacitor 120 through diode 116 and resistor 118. When timing capacitor 120 has charged to a predetermined extent and the voltage applied to the gate of silicon controlled rectifier (SCR) 124 via resistor 122 has reached a predetermined threshold level, SCR 124 conducts current from terminal 101 through resistors 126 and 128 to the cathode of Zener diode 130. Timing capacitor 120 is provided so that SCR 124 is not triggered by momentary false closings of the alarm monitor circuit. Timing capacitor 120 may have a time constant of 0.5 second, for example.

Once SCR 124 conducts, it continues to conduct until the potential applied to its gate terminal is pulled below the cut-off potential. Programmable unijunction transistor device 132 is normally non-conducting so that the potential applied to the gate of SCR 124 is held above the cut-off potential by the flow of current from the cathode of SCR 124 through resistor 134 to capacitor 136, etc.

When SCR 124 conducts, transistor 106 conducts and an output signal is applied to terminal 113 which turns on logic power supply 14 in FIG. 1 unless that power supply is already on. When SCR 124 conducts, Zener diode 130 also conducts current from SCR 124 through resistor 138 to ground. This raises the potential applied to the base of transistor 108 and causes that device to conduct current from terminal 107 through resistor 140 to ground. The signal applied to inverter 110 therefore changes from logical 1 to logical 0 and the output signal of inverter 110 applied to alarm output terminal 109 becomes logical 1 as is required to indicate that the alarm condition monitored by the alarm sensor has occurred. Alarm output terminal 109 is connected to one of NAND gates 30 in FIG. 1. Reset pulse generator 142 also responds to the change from logical 1 to logical 0 in the signal applied to inverter 110 by producing an output pulse applied to terminal 111 for resetting flip-flops 20 and 22 and binary counter 24 in FIG. 1.

As mentioned above, once SCR 124 conducts, it continues to conduct until turned off by the conduction of programmable unijunction transistor 132. As long as SCR 124 conducts, transistors 106 and 108 conduct, so that logic power supply 14 in FIG. 1 is held on and the alarm sensor continues to produce an alarm indicating output signal regardless of further possible changes in the status of alarm monitor 104. In other words, once the alarm sensor has been triggered, it latchs and remains triggered until reset by an appropriate signal applied to terminal 115. This prevents further changes in the status of alarm monitor 104 from interrupting the operation of the transmitter apparatus of FIG. 1 and permits that apparatus to complete a normal transmission sequence once that sequence is begun.

The alarm sensor is reset when the output signal of NAND gate 32 if FIG. 1 goes to logical 0 at the completion of a transmission sequence. Accordingly, the output terminal of NAND gate 32 is connected to terminal 115 in FIG. 4. When the output signal of NAND gate 32 goes to logical 0, current flows from terminal 135 through diode 150, resistors 152 (connected in parallel with capacitor 154), resistor 156, and diode 158 to terminal 115. This causes programmable unijunction transistor 132 to conduct current to ground, thereby lowering the potential applied to the gate of SCR 124 below the cut-off potential and cutting off that device. When SCR 124 ceases to conduct, transistors 106 and 108 cease to conduct and logic power supply 14 in FIG. 1 is turned off. If alarm monitor 104 is still providing a closed circuit between terminals 103 and 105, programmable unijunction transistor 132 continues to conduct, thereby preventing the charging of timing capacitor 120 and the re-triggering of the alarm sensor. Whenever alarm monitor 104 becomes open-circuited thereafter, programmable unijunction transistor 132 ceases to conduct and the alarm sensor can be re-triggered by another occurrence of the alarm condition monitored by alarm monitor 104. In this way the system does not transmit alarm signals indicative of the same occurrence of an alarm condition. If alarm monitor 104 is open-circuited when a reset signal is applied to terminal 115, programmable unijunction transistor 132 conducts only momentarily and the alarm sensor is fully reset to trigger in response to another closing of the alarm monitor circuit.

FIG. 5 shows a reset pulse generator suitable for use for either reset pulse generator 50 in FIG. 1 or reset pulse generator 142 in FIG. 4. Terminal 171 is the input terminal of the apparatus and terminal 179 is the output terminal. when a logical 1 signal is applied to input terminal 171, inverter 172 applies a logical 0 signal to output terminal 179. Inverter 174 similarly applies a logical 0 signal to capacitor 176 and inverter 178. The output signal of inverter 178 would be logical 1 but it is held to logical 0 by inverter 172. When the signal applied to input terminal 171 changes from logical 1 to logical 0, the output signal of inverter 172 changes to logical 1. Since some time is required for inverter 174 to charge capacitor 176, the signal applied to inverter 178 remains effectively logical 0 for a short period of time. Accordingly, the signal applied to terminal 179 changes to logical 1 for a short time until capacitor 176 is sufficiently charged to cause the output signal of inverter 178 to go to logical 0. The circuit shown in FIG. 5 therefore produces a short logical 1 pulse each time the signal applied to it changes from logical 1 to logical 0.

FIG. 6 shows a protective circuit which can be employed in conjunction with the transmitter apparatus of FIG. 1 in accordance with the principles of this invention to disable a remote station which is malfunctioning and transmitting continuously for a period of time in excess of the maximum normal transmission interval. It is desirable to prevent such a transmitter from continuing to transmit since the signals produced by that transmitter may prevent reception of signals from other transmitters operating on the same frequency in the same geographical area.

As in FIG. 1, main power supply 10 supplies power to alarm sensors 0–3 and to other portions of the remote station apparatus requiring power from main power supply 10 via terminal 13. As shown if FIG. 6, however, main power supply 10 is connected to terminal 13 across fuse 11. Main power supply 10 is also connected to ground across fuse 11 and normally non-conducting SCR 244. When SCR 244 conducts as described below, main power supply 10 is effectively short-circuited to ground across fuse 11. Fuse 11 therefore burns out and the remote station is disabled.

In FIG. 6 elements 204, 206, and 208 represent various portions of transmitter 94 in FIG. 1. The frequency shift modulated AC signal representing the data to be transmitted is applied to control element 204 via terminal 201. This signal may be the output signal of oscillator 92 in FIG. 1. Control element 204 passes the signal applied to terminal 201 to a series of amplification stages including stages 206 and 208 when element 204 is enabled by an appropriate control signal applied to terminal 203. The control signal applied to terminal 203 is the output signal of inverter 40 in FIG. 1. The amplified output signal of transmitter 94 is applied to antenna 96 as in FIG. 1.

At some point downstream of control element 204 (e.g., between amplification stage N and amplification stage N + 1), the signal being processed is AC coupled to a timing circuit by coupling capacitor 210. The AC output signal of capacitor 210 is rectified by diode 212 and resistor 214, and the rectified signal is converted to a substantially DC signal by low pass filter means including resistor 216 and capacitor 218. This DC signal is applied to voltage dividing resistors 220 and 222. The base of transistor 224 is connected intermediate resistors 220 and 222 so that transistor 224 conducts when current is flowing through resistor 220 and 222. Accordingly, transistor 224 conducts current from main power supply 10 through resistor 226 to ground while transmitter 94 is operating to transmit information. When transistor 224 begins to conduct, the potential at point 229, connected to the collector of transistor 224 through resistor 228 and connected to main power supply 10 through capacitor 230, begins to fall from the potential supplied by main power supply 10, thereby lowering the potential applied to the base of transistor 234. Resistor 228 is connected in parallel with diode 232. The emitter of transistor 234 is connected to main power supply 10 across Zener diode 236 and the collector of transistor 234 is connected to ground across voltage dividing resistors 238 and 240. Capacitor 242 is connected in parallel with resistor 240. When transistor 234 becomes sufficiently conductive, Zener diode 236 begins to conduct and the potential at point 239 intermediate resistors 238 and 239 rises. Accordingly, resistor 228 and capacitor 230 act as a timing circuit and elements 234 and 236 act as a threshold detector, suddenly raising the potential at point 239 when the signal at point 229 reaches a predetermined threshold level. The time required for the potential at point 229 to reach the threshold level required to cause elements 234 and 236 to conduct is selected to be somewhat longer than the maximum normal continuous transmission interval. For example, when the maximum normal continuous transmission interval is approximately 16 seconds (see FIG. 2*d*), the time required to reach this threshold level may be approximately 30 seconds.

Point 239 is connected to the gate of SCR 244. When elements 234 nad 236 conduct and the potential at point 239 rises, SCR 244 conducts and effectively provides a short curcuit form main power supply 10 across fuse 11 to ground. power to the remote station apparatus and completely disabling the remote station.

If one alarm sensors 0–3 is triggered periodically to cause transmission of signals indicating that the remote station is functioning normally, the fact that the remote station has been disabled will be apparent when the remote station fails to transmit those signals.

The central station receiver apparatus shown in FIG. 7 receives and demodulates the radio frequency signals transmitted by remote station apparatus of the type described above to produce a data output signal having timing pulses corresponding to the data signal applied to FSK modulator 90 in the typical remote station. This data signal is decoded by the receiver apparatus to produce a 16 bit data word stored in data shift register 362 corresponding to the 16 bit data work transmitted by a remote station during any transmission interval. (A frame pulse is stored in shift register 362 as a binary 0.) The decoder apparatus of FIG. 7 performs a number of operations on the received data signal to insure that the information stored in shift register 362 is a valid and correct alarm data word. The received data signal is blanked after each timing pulse except when a valid succeeding timing pulse can occur to reduce the probablility that the decoder will respond to a spurious timing pulse caused by noise or ohter interference. The decoder counts the number of bits received between frame pulses to insure that received data words include the correct number of bits. Twosuccessive identical data words must be received before that data ward is determined to be a valid data word. If the receiver access code is employed, the received data word in shift register 362 must also include the correct receiver access code for the particular central station.

When the decoder apparatus has determined that a valid data word is stored in shift register 362 (and that the data word includes the correct receiver access code if necessary), the decoder produces a control transfer output signal applied to terminal 373 which indicates that an alarm data word has been received and initiates further processing of that alarm data word, for example, to alert an operator of the system that an alarm has been received. Illustrative apparatus for such further processing of alarm data words is shown in FIG. 8. This apparatus compares the data word in shift register 362 with several previously received data words and retains the data word only if it has not already been received. Retained data words are decoded and displayed in a form which is more readily interpreted by the system operator. When a displayed data word is acknowledged by the operator, it is discarded.

Considering the central station receiver apparatus of FIG. 7 now in greater detail, that apparatus includes antenna 302 and receiver 304 for receiving the radio frequency signals transmitted by any of several remote station transmitters of the type described above. All of the remote station transmitters transmitting signals to the central station apparatus shown in FIG. 7 operate on the same frequencies. Antenna 302 and receiver 304 are therefore tuned to receive signals of those frequencies and to exclude all other radio frequency signals. The central station receiver is able to respond to signals from many remote stations transmitting on the same frequencies because the short time required to transmit a data word and the fact that each data word is transmitted many times during several spaced transmission intervals makes it extremely unlikely that the entire transmission of any remote station will be completely obscured by transmission from any other remote station or stations.

The output signal of receiver 304 is applied to demodulator 306 which demodulates that signal to produce a data output signal similar to the data signal applied to FSK modulator 90 in the typical remote station transmitter when an alarm signal is being received. The output signal of demodulator 306 is applied to pulse shaper 308 which shapes the pulses in the output signal of demodulator 306 and produces a short logical 1 output pulse at the trailing edge of each logical 1 pulse in the shaped output signal of demodulator 306. Accordingly, the output signal of pulse shaper 308 represents the data received by the receiver, but the logical 1 pulses in that signal are considerably shorter than in the original data signal illustrated, for example, in FIG. 3*b*. The logical 1 pulses are shortened in this manner to facilitate processing in the decoder portion of the receiver apparatus as will now be described.

Before any logical 1 data pulse is produced by pulse shaper 308, flip-flop 310 is reset to the condition in which Q1 is logical 0 and $\overline{Q1}$ is logical 1. Clock 312 produces a timing signal applied to the C input terminal of binary counter 314. Clock 312 operates at a much faster rate than the basic data clock rate determined by clock 28 in the remote station transmitter apparatus (see FIG. 3*a*). For example, if clock 28 operates at 1KHz as in the embodiment of the transmitter apparatus discussed in detail above, clock 312 may operate at 40KHz. Binary counter 314 is similar to binary counter 24 in the transmitter apparatus except that each time the count registered by counter 314 reaches the equivalent of decimal 9, the counter resets to zero when the next pulse is to be counted. Counter 314 counts the timing pulses produced by clock 312. Accordingly, the D output signal of counter 314 is a second timing signal having one logical 1 timing pulse for every 10 timing pulses in the output signal of clock 312. While Q1 is logical 0, the output signal of inverter 316 is logical 1, permitting this second timing signal to be applied to the $\overline{C}$ input terminal of shift register 340 in inverted form via inverter 318. Similarly, while $\overline{Q1}$ is logical 1, the output signal of inverter 320 is logical 0 which prevents this second timing signal from being applied to the *d* input terminal of state counter 326 via inverters 322 and 324. State counter 326 applies a logical 0 signal to the output terminal $\overline{0}$–$\overline{9}$ corresponding to the decimal equivalent of the four digit binary number applied to input terminals *a–d.* The signals applied to state counter input terminals *a–d* are interpreted respectively as the zero through third powers of decimal 2. If the signal applied to input terminal *d* is logical 1, counter 326 ignores the signals applied to input terminals *c* and *b.* Output terminals A–C of binary counter 314 are respectively connected to input terminals *a–c* of state counter 326. Accordingly, while $\overline{Q1}$ is logical 1 and the signal applied to input terminal *d* is logical 1, state counter 326 alternately applied a logical 0 signal to output terminals $\overline{8}$ and $\overline{9}$ as binary counter 314 counts the timing pulses produced by clock 312.

Each time state counter 326 applies a logical 0 signal to output terminal $\overline{9}$, flip-flop 328 is clocked. When flip-flop 328 is clocked, the $\overline{Q2}$ output signal of that device changes (if necessary) to correspond to the signal applied to the K input terminal of that device. Since input terminals J and K of flip-flop 328 are respectively connected to output terminals Q1 and $\overline{Q1}$ of flip-flop 310, $\overline{Q2}$ remains logical 1 while $\overline{Q1}$ is logical 1. As long as Q1 is logical 1, flip-flop 330, which is initially reset, is not clocked by the signal applied to its $\overline{C}$ input terminal. While flip-flop 330 is reset, Q3 is logical 0 and $\overline{Q3}$ is logical 1. While Q3 is logical 0, binary counter 314 is not reset and continues to count as described above; and while Q3 is logical 1, the state of flip-flop 328 is not affected by the signal applied to its reset input terminal $\overline{R}$.

When the first logical 1 data pulse is applied to flip-flop 310, the trailing edge of that pulse causes flip-flop 310 to change to the state in which Q1 is logical 1 and $\overline{Q1}$ is logical 0. The change in $\overline{Q1}$ from logical 1 to logical 0 causes flip-flop 330 to change to the state in which Q3 is logical 1 and $\overline{Q3}$ is logical 0. The change in Q3 from logical 0 to logical 1 resets binary counter 314 to zero, and the change in $\overline{Q3}$ from logical 1 to logical 0 resets flip-flop 328. In fact, however, no change occurs in the state of flip-flop 328 at this time. With $\overline{Q1}$ now logical 0, the output signal of inverter 320 is logical 1 and the A–D output signals of binary counter 314 are respectively applied to input terminals *a–d* of state counter 326. Since binary counter 314 has been reset to zero, state counter 326 applies a logical 0 signal to output terminal $\overline{0}$ and flip-flop 330 is reset.

As clock 312 produces successive timing pulses counted by binary counter 314, state counter 326 applies a logical 0 signal to successive output terminals $\overline{1}$–$\overline{9}$. Since the operations performed when output terminals $\overline{1}$, $\overline{2}$, and $\overline{4}$ are thus selected by state counter 326 will be clearer after the processing of the first data pulse has been described, discussion of those operations is deferred until later. When output terminal $\overline{3}$ of state counter 326 is logical 0, the output signal of inverter 332 is logical 1 and binary counter 334 (similar to binary counter 24 in FIG. 1) advances by one count. Counter 334 counts the number of bits in a received data word to insure that a word has 15 data bits and a frame pulse before it can be recognized as a valid data word. When output terminal $\overline{5}$ of state counter 326 is logical 0, shift register 340 is reset by the signal applied to its reset input terminal $\overline{R}$, i.e., the contents of shift register 340 are cleared to all zeros. Shift register 340 is a 15 bit binary shift register which shifts its contents one place from left to right as viewed in FIG. 7 each time a negative-going pulse is applied to its clock input terminal $\overline{C}$. The contents of the 15 places of shift register 340 are respectively applied to output terminals A–0. For example, if the left-most place of shift register 340 contains binary 1, the signal applied to output terminal A is logical 1, etc. Shift register 340 enables the decoder portion of the receiver apparatus to respond to a logical 1 pulse in the data output signal produced by pulse shaper 308 when such a logical 1 pulse can occur following each succeeding logical 1 pulse (i.e., approximately 1, 2, and 3 milliseconds after a logical 1 pulse has occurred, representing binary 0, binary 1, and a frame pulse, respectively). At other intermediate times, shift register 340 in conjunction with elements 344, 346, 348, 352, and 354 prevent the decoder apparatus from responding to a logical 1 pulse in the output signal of pulse shaper 308 to prevent the decoder from responding to spurious logical 1 pulses caused by noise and other interference.

When logical 0 is applied to output terminal $\overline{6}$ of state counter 326, the output signal of inverter 342 is logical 1 and shift register 340 is preset by the signal thus applied to its PRESET input terminal. Shift register 340 is preset by storing a binary 1 in each of the two places associated with output terminals A and B. Accordingly, output signals A and B of shift register 340 are logical 1 and all the other output signals of shift register 340 are logical 0. Of terminals A and B, only the signal applied to terminal B is used. This signal is applied to one of four inverters 344*a–d*. When the signal applied to any of inverters 344*a–d* is logical 1, the output signal of that inverter is logical 0. When the output signal of any of inverters 344*a–d* is logical 0, the signal applied to inverter 346 is logical 0 and the output of that device is logical 1. When the output signals of inverters 346 and 352 are both logical 1, the signal applied to inverter 354 is logical 1 and the output signal of that device is logical 0. While the output signal of inverter 354 is logical 0, flip-flop 310 is prevented from responding to another logical 1 data pulse in the output signal of pulse shaper 308. The output signal of inverter 354 is a so-called noise blanking signal because it prevents the decoder apparatus from responding to a logical 1 pulse in the data signal except when a valid logical 1 pulse can occur in that signal.

The circuit including elements 346, 348, 350, and 352 will be recognized as a timing circuit similar to the timing circuit shown in FIG. 5. When the output signal of any of inverters 344*a–d* first goes to logical 0, the output signal of inverters 346 and 348 immediately go to logical 1. The signal applied to inverter 352, however, remains effectively logical 0 until capacitor 350 has changed to a predetermined extent. Thereafter, the output signal of inverter 352 goes to logical 0 and the output signal of inverter 354 goes to logical 1, thereby enabling flip-flop 310 to respond to another logical 1 pulse in the applied data signal regardless of the condition of shift register 340. The time required for the output signal of inverter 352 to change to logical 0 following a change to logical 1 in the output signal of inverter 348 is chosen to be slightly longer than the maximum blanking interval produced by shift register 340 when that device is functioning normally. For example, the time required for the output signal of inverter 352 to change to logical 0 following a change in the output signal of inverter 348 may be in excess of 1.5 milliseconds, preferably in the range from 1.5 to 2.5 milliseconds. This timing circuit therefore assures that further data pulses will be processed by the decoder even if shift register 340 becomes temporarily stalled or otherwise malfunctions. In the further discussion of the decoder apparatus herein, it will be assumed that shift register 340 functions normally so that the timing circuit just described does not override the output signals of shift register 340. Accordingly, when shift register 340 applies a logical 1 signal to any of output terminals B, C, G, or K, the output signal of inverter 354 is logical 0 and flip-flop 310 is prevented from responding to another logical 1 pulse in the signal applied to it from pulse shaper 308.

Returning to the discussion of the successive states of state counter 326, when a logical 0 signal is again applied to state counter output terminal $\overline{9}$, flip-flop 328 is clocked again. Since $\overline{Q1}$ is logical 0, $\overline{Q2}$ becomes logical 0, thereby resetting flip-flop 310 to the condition in which Q1 is logical 0 and $\overline{Q1}$ is logical 1. Flip-flops 310, 328, and 330 have now returned to their initial conditions (although flip-flop 310 is prevented from responding to another logical 1 data pulse by the output signal of inverter 354 as mentioned above). Accordingly, the D output signal of binary counter 314 (including a timing pulse for even 10 timing pulses in the output signal of clock 312) is again applied to the $\overline{C}$ input terminal of shift register 340 via inverter 318 and the signal applied to the *d* input terminal of state counter 326 is clamped to logical 1 by inverters 320 and 324. State counter 326 alternately applies a logical 0 signal to output terminals $\overline{8}$ and $\overline{9}$ as counter 314 continues to count the timing pulses produced by clock 312.

When counter 314 has counted another eight timing pulses after state counter 326 first returns to the condition in which it again applies a logical 0 signal to output terminal $\overline{9}$, shift register 340 is clocked by the D output signal of counter 314. The contents of shift register 340 therefore shift one place to the right so that output signals B and C of shift register 340 are logical 1 and the remaining output signals of that device are logical 0. Flip-flop 310 continues to be inhibited by the output signal of inverter 354.

When counter 314 has counted another ten timing pulses produced by clock 312, shift register 340 is again clocked by the D output signal of counter 314. Shift register 340 again shifts one place to the right so that its C and D output signals are logical 1 and the remaining output signals are logical 0. Flip-flop 310 continues to be inhibited by the output signal of inverter 354.

When counter 314 counts another 10 timing pulses produced by clock 312, shift register 340 is clocked again and shifts another place to the right so that its D and E output signals are logical 1 and the remaining output signals are logical 0. Since all of the signals applied to inverters 344*a–d* are now logical 0, the signal applied to inverter 346 is logical 1. The output signal of that device is therefore logical 0 and the output signal of inverter 354 is logical 1. Flip-flop 310 is therefore enabled to receive a logical 1 data pulse for the first time since shift register 340 was preset. This occurs somewhat less than 40 clock 312 timing pulses after the end of the first logical 1 data pulse applied to flip-flop 310. Accordingly, flip-flop 310 is enabled to receive a logical 1 data pulse in slightly less than 1 millisecond after the end of the first logical 1 data pulse. Since a valid logical 1 data pulse cannot occur prior to that time, shift register 340 and associated apparatus effectively prevent the decoder apparatus from responding to spurious signals such as those caused by noise which may occur between valid data pulses.

If a second logical 1 data pulse does not occur while the D and E output signals of shift register 340 are logical 1, shift register 340 shifts another place to the right when another 10 timing pulses have been counted by counter 314. The E and F output signals of shift register 340 will then be logical 1 and flip-flop 310 will continue to be enabled to receive a logical 1 data pulse. If such a pulse is not received while the E and F output signals of shift register 340 are logical 1, shift register 340 again shifts one place to the right when another 10 timing pulses have been counted by counter 314. The F and G output signals of shift register 340 will then be logical 1 and flip-flop 310 will again be prevented from responding to a logical 1 data pulse by the output signal of inverter 354. Accordingly, when shift register 340 reaches the state in which the D and E output signals are logical 1, flip-flop 310 is enabled to receive another logical 1 data pulse and remains enabled for approximately 0.5 milliseconds until another 20 timing pulses have been produced by clock 312 and the G output signal of shift register 340 becomes logical 1. If a logical 1 data pulse is applied to flip-flop 310 during this 0.5 millisecond interval, the decoder responds as discussed in succeeding paragraphs to indicate that a binary 0 has been transmitted. If no logical 1 data pulse is detected during this interval, the decoder looks for a logical 1 data pulse at a later time, indicating that a binary 1 or a frame pulse has been transmitted.

If a second logical 1 data pulse is applied to flip-flop 310 while either the D and E or E and F output signals of shift register 340 are logical 1, the exact same sequence of events occurs as when the first logical 1 data pulse was applied to flip-flop 310. Accordingly, flip-flop 310 changes to the state in which Q1 is logical 1 and $\overline{Q1}$ is logical 0. This stops the clocking of shift register 340 and clocks flip-flop 330 so that Q3 is logical 1 and $\overline{Q3}$ is logical 0. When Q3 goes to logical 1, binary counter 314 is reset to zero and all four output signals of counter 314 are applied to input terminals *a–d* of state counter 326. Since binary counter 314 is reset to zero, state counter 326 applies a logical 0 signal to output terminal $\overline{0}$ and flip-flop 330 is reset.

As successive timing pulses are counted by binary counter 314, state counter 326 applies a logical 0 signal to successive output terminals $\overline{1}$–$\overline{9}$. When a logical 0 signal is applied to output terminal $\overline{1}$, NAND gate 358 is partially enabled by the output signal of inverter 356. Assuming, however, that the second logical 1 data pulse occurs while the D and E or E and F output signals of shift register 340 are logical 1, NAND gate 358 is disabled by the logical 0 signal applied to the M output terminal of shift register 340. The logical 1 output signal of inverter 356 also enables comparator 360 which then compares the output signal of 16 bit shift register 362 (i.e., the oldest bit stored in shift register 362) with the signal applied to the I output terminal of shift register 340. Shift register 362 stores the 16 bits of the last data word decoded by the decoder. The frame pulse at the end of that data word is represented in shift register 362 as a binary 0. If the logical 1 data pulse being processed by the decoder occurs while logical 1 signals are applied to output terminals D and E or E and F of shift register 340, the signal applied to the upper input terminal of comparator 360 is logical 0. If the corresponding bit in the last data word decoded by the decoder and stored in shift register 362 is binary 0, logical 0 is also applied to the lower input terminal of comparator 360 and the output signal of comparator 360, which is normally logical 1, remains logical 1 to indicate that the data bit which has just been received is the same as the corresponding bit in the last word received. If the output signal of shift register 362 is logical 1, indicating that the corresponding bit in the last word is binary 1, the data bit which has just been received is not the same as the corresponding bit in the last data word and the output signal of comparator 360 goes to logical 0, clocking error flip-flop 364 and causing Q4 to change from logical 0 to logical 1 to correspond to the signal applied to its J input terminal if flip-flop 364 has not already been clocked since it was last reset.

When a logical 0 signal is applied to output terminal $\overline{2}$ of state counter 326, shift register 362 shifts one place to the right, thereby discarding the oldest bit stored in shift register 362 (i.e., the bit just applied to comparator 360) and storing as a newest bit the signal applied to its data input terminal from the I output terminal of shift register 340. If the discarded bit is the same as the bit being decoded, shift register 362 is merely storing the same information again. If the bit being decoded is different from the discarded bit, shift register 362 is storing a new data word.

When a logical 0 signal is applied to output terminal $\overline{3}$ of state counter 326, the logical 1 output signal of inverter 332 advances the count of binary counter 334.

When a logical 0 signal is applied to output terminal $\overline{4}$ of state counter 326, NAND gate 368 is partially enabled by the logical 1 signal applied to it from inverter 366. NAND gate 368 is fully enabled only if the M output signal of shift register 340 is also logical 1, indicating that a frame pulse has been received. The decoder therefore tests for the occurrence of a frame pulse each time state counter output signal $\overline{4}$ is logical 0.

When a logical 0 signal is applied to output terminal $\overline{5}$ of state counter 326, decoding of the bit just received is complete and shift register 340 is reset to all zeros. When logical 0 is applied to state counter output terminal $\overline{6}$, shift register 340 is preset to apply logical 1 signals to output terminals A and B. And when logical 0 is applied to state counter output terminal $\overline{9}$, flip-flop 328 is clocked, thereby restoring flip-flop 310 to its initial condition. Shift register 340 then begins to shift to the right as after the first logical 1 data pulse was received and the decoder apparatus is again ready to respond to another appropriately time logical 1 data pulse.

If the second logical 1 data pulse is not received during the approximately 0.5 millisecond interval that logical 1 signals are applied to output terminals D and E and E and F of shift register 340, flip-flop 310 is again disabled by the output signal of inverter 354 for approximately 0.5 milliseconds while logical 1 signals are first applied to output terminals F and G and then to output terminals G and H of shift register 340. When shift register 340 applies logical 1 signals to output terminals H and I, flip-flop 310 is again enabled to receive a logical 1 data pulse. This first occurs slightly less than 2 milliseconds after the end of the first logical 1 data pulse. If a logical 1 data pulse was not received approximately 1 millisecond after the first data pulse, the next time that a valid data pulse can occur is approximately 2 milliseconds after the first data pulse. Accordingly, during a substantial portion of the time when a valid data pulse cannot occur between 1 and 2 milliseconds after the end of the first data pulse, flip-flop 310 is prevented from responding to a spurious logical 1 pulse in the output signal of pulse shaper 308. After logical 1 signals are first applied to output terminals H and I of shift register 340, flip-flop 310 is again enabled to receive a logical 1 data pulse for approximately 0.5 milliseconds while logical 1 signals are applied to output terminals H and I and then to output terminals I and J of shift register 340. If no second locgical 1 data pulse occurs during this 0.5 millisecond interval, neither a binary 0 nor a binary 1 has been transmitted and flip-flop 310 is disabled for another 0.5 millisecond interval while logical 1 signals are first applied to output terminals J and K and then to output terminals K and L of shift register 340.

If the second logical 1 data pulse occurs while logical 1 signals are applied to either output terminals H and I or I and J of shift register 340, a binary 1 has been transmitted. Exactly the same operations are performed as when the second logical data pulse occurs while output signals D and E or E and F of shift register 340 are logical 1. In this case, however, the signal applied to output terminal I of shift register 340 is logical 1 so that the corresponding bit of the previously decoded data word stored in shift register 362 must be binary 1 or comparator 360 will produce an output signal for clocking error flip-flop 364. Similarly, shift register 362 will store a binary 1 when shifted one place to the right. Shift register 340 is then reset and preset and the decoder begins looking for another appropriately timed logical 1 data pulse.

If the second logical 1 data pulse does not occur before shift register 340 first applies logical 1 signals to output terminals J and K, neither a binary 0 nor a binary 1 has been transmitted. A second valid data pulse cannot then occur until approximately 3 milliseconds after the first data pulse, as when a frame pulse is transmitted. Flip-flop 310 is again disabled for approximately 0.5 milliseconds as mentioned above until logical 1 signals are first applied to output terminals L and M of shift register 340, slightly less than 3 milliseconds after the end of the first logical 1 data pulse. Flip-flop 310 is then again enabled for approximately 0.5 milliseconds while logical 1 signals are applied to output terminals L and M and then to output terminals M and N of shift register 340. If a second logical 1 data pulse is not received during this 0.5 millisecond interval, shift register 340 applies logical 1 signals to output terminals N and O. Since it has now been almost 3.5 milliseconds since the end of the first logical 1 data pulse, no valid data pulse can be received. Accordingly, the logical 1 signal applied to shift register output terminal 0 is inverted by inverter 370 and clocks error flip-flop 364. Shift register 340 is reset when another data pulse is applied to flip-flop 310.

If a second logical 1 data pulse occurs during the 0.5 milliseconds while logical 1 signals are applied to shift register output terminals L and M or M and N, a frame pulse has been transmitted. Again, exactly the same operations are performed as when a binary 0 or 1 has been transmitted, except that now the signal applied to shift register output terminal M is logical 1. If this frame pulse ends the first transmission of a given data word, the data previously stored by shift register 362 will not have been the same as the data word just decoded. Error flip-flop 364 will therefore have been set during decoding of this data word. When a logical 0 signal is applied to state counter output terminal $\overline{1}$, NAND gate 358 is at least partially enabled by the logical 1 signals applied to its two upper input terminals and may be fully enabled if the C output of bit counter 334 is also logical 1. However, even if NAND gate 358 is fully enabled and the signal applied to inverter 372 is logical 0, the signal applied to output terminal 373 remains logical 0 as long as Q4 is logical 1 and the output signal of inverter 374 is therefore logical 0.

When logical 0 is applied to state counter output terminal $\overline{2}$, shift register 362 shifts one place to the right and stores a binary 0 corresponding to receipt of a frame pulse. When logical 0 is applied to state counter output terminal $\overline{3}$, bit counter 334 is advanced by the logical 1 output signal of inverter 332. When logical 0 is applied to state counter output terminal $\overline{4}$, NAND gate 368 is fully enabled by the logical 1 signals applied to its two input terminals. Accordingly, the output signal of NAND gate 368 goes to logical 0 which resets error flip-flop 364 and bit counter 334. Bit counter 334 is reset to a count of zero.

If the data word just decoded is the second of two successive identical data words, shift register 362 will have stored the same data word as has just been decoded. Accordingly, error flip-flop 364 will not have been set during the decoding of the data word just received. Also, 16 logical 1 data pulses will have occurred since bit counter 334 was reset at the end of the last frame pulse, so that output signals A–D of bit counter 334 will all be logical when the frame pulse at the end of the second data word is detected. When logical 0 is now applied to state counter output terminal $\overline{1}$, NAND gate 358 is fully enabled. The output signal of NAND gate 358 is therefore logical 0 and the output signal of inverter 372 is logical 1. NAND gate 378, connected to output terminals A, B, and D of bit counter 334, is also enabled. The output signal of NAND gate 378 is therefore also logical 0 and the output signal of inverter 380 is logical 1. Q4 is also logical 0 and the output signal of inverter 374 is logical 1. If the receiver access code feature is employed as described below, and if the data word stored in shift register 362 includes the receiver access code number of this particular central station, the signal applied to output terminal 373 goes to logical 1 for the first time. A logical 1 signal applied to output terminal 373 indicates that two successive identical data words have been received and that the data word stored in shift register 362 (the latter of these two successive data words) is an alarm signal to which the central station must respond. The logical 1 signal applied to output terminal 373 is a transfer control signal which initiates further processing of the alarm data word in shift register 362, for example, to alert the operator of the system to the occurrence of an alarm and inform him of the remote station location and type of that alarm. For example, the control transfer output signal may cause the alarm data word stored in shift register 362 to be decoded to decimal numbers representing the remote station transmitting that alarm data word and the alarm condition occurring at that remote station. These decimal numbers may be optically displayed in front of the operator of the system. More sophisticated apparatus of this type is shown in FIG. 8 and described in detail below.

If the system employs the receiver access code feature of this invention, each data word transmitted by a remote station includes one or more bits representing the code number of several central stations within range of the remote station which is to respond to signals transmitted by that remote station. Central stations with different code numbers do not respond to data words transmitted by that remote station. This permits more remote stations to be operated in a given area than could be accommodated by a single central station, for example, because of the possibility that alarm signals could occur more rapidly than could be responded to and acknowledged by a single operator. In the particular embodiment shown in the drawing, the last two bits of each data word are the receiver access code number (see FIG. 3*b*). When a complete data word has been received by a central station, the receiver access code bits of that data word are stored in the left-most two storage locations of shift register 362. These two bits are respectively applied to EXCLUSIVE OR gates 390 and 392 for comparison to the receiver access code number of that central station established by the settings of switches 394 and 396. If the receiver access code bits are the same as the receiver access code of the central station, the output signals of EXCLUSIVE OR gates 390 and 392 are both logical 1 and a control transfer output signal is applied to output terminal 373 when the output signals of inverters 372, 374, and 380 are all logical 1. If the receiver access code bits in shift register 362 are different from the receiver access code of the central station, the output signals of one or both of EXCLUSIVE OR gates 390 and 392 are logical 0 and a control transfer output signal is not applied to output terminal 373 when the output signals of inverters 372, 374, and 380 are logical 1. The central station therefore responds only to alarm data words having the receiver access code number of that central station.

Any of a variety of data processing means can be provided for further processing the data words decoded by the decoder of FIG. 7, for example, to inform the operator of the system that an alarm signal has been received. Illustrative apparatus for this purpose constructed in accordance with the principles of this invention is shown in FIG. 8.

In FIG. 8, memory 402 includes a plurality of storage locations, each capable of storing one alarm data word. In the illustrative embodiment shown in FIG. 8, memory 402 has four such storage locations, each of which may be visualized as a horizontal portion of the memory respectively connceted between one data input terminal and one data output terminal. Under the control of controller 404, the data word in the top-most storage location of memory 402 is also stored in display register 406. The binary data word in display register 406 is decoded by decoder 408 to produce signals suitable for driving display 410 which produces a visual representation of the data word in register 406 intelligible to the operator of the system. For example, display 410 may provide a visual decimal representation of the binary data word in register 406.

Controller 404 maintains a record of or can otherwise determine which storage locations in memory 402 contain data words and which are empty. When the operator of the system presses a button to acknowledge the alarm information currently being displayed by display 410, the contacts of switch 412 close. Responsive to the closing of switch 412, controller 404 clears the top-most storage location of memory 402 and shifts the contents of the remaining storage location up one location so that a new data word is stored in the top-most location in memory 402. This new data word is also stored in display register 406 and accordingly displayed by display 410 until acknowledged by the operator.

When two successive identical data words (with the correct receiver access code if necessary) have been decoded by the decoder apparatus shown in FIG. 7 and the signal applied to terminal 373 accordingly goes to logical 1, controller 404 responds to this logical 1 signal by applying a signal to output terminal 405 which causes shift register 362 in FIG. 7 to recirculate its contents at a predetermined rate rather than to accept any new data bits from the remainder of the decoder apparatus. The data output signal of shift register 362 is applied to one input terminal of comparator 414 in FIG. 8 via terminal 363. At the same time controller 404 causes the contents of one storage location of memory 402 to be applied to the other input terminal of comparator 414 for comparison with the data word in shift register 362. Controller 404 selects each storage location of memory 402 in turn for comparison in this manner. Alternatively, comparator 414 may be capable of simultaneously comparing the contents of all four storage locations of memory 402 with the data word stored in shift register 362. If the data word in shift register 362 matches any of the data words currently stored in memory 402, comparator 414 produces an output signal indicating that the data word just decoded is already in memory 402 and is not needed. Controller 404 therefore produces an output signal applied to terminal 405 which stops the recirculation of the contents of shift register 362 and permits the decoder of FIG. 7 to resume decoding received alarm signals.

If the data word in shift register 362 does not match any of the data words currently stored in memory 402, controller 404 causes memory 402 to store the data word from shift register 362 in the highest storage location in the memory which does not already contain a data word. This newly received data word will be decoded and displayed by display 410 when all previously acknowledged data words in memory 402 have been acknowledged.

The apparatus shown in FIG. 8 therefore comprises means for storing a number of alarm data words until they are acknowledged and for preventing the system from responding repeatedly to the same alarm data word as long as that data word is unacknowledged. This apparatus therefore provides a highly desirable buffer between the relatively rapid transmission of data to the central station and the relatively slow response of the operator of the system and reduces or eliminates redundant alarm information transmitted to the central station.

It is to be understood that the embodiments shown and described herein are illustrative of the principles of this invention only, and that various modifications can be implemented by those skilled in the art without departing from the scope and spirit of the invention. For example, although data words having 15 data bits and a frame pulse are employed in the embodiment discussed in detail herein, data words of any length can be used as desired. Similarly, any number of alarm conditions can be monitored by the remote stations of this invention. The transmission sequences produced by the remote stations can also be modifed, for example, by using different output signals of counter 24 in FIG. 1 to control variable clock 18 and transmitter 94 and to generate the signal for resetting the alarm sensors. A counter 24 with more than four output terminals can also be used to generate much more complicated transmission sequences, and different remote stations can be arranged to produce different transmission sequences to further reduce the probability that signals transmitted by one remote station will be obscured by signals transmitted by other remote stations.

What is claimed is:

1. In a radio central station alarm system including a central station and a plurality of remote stations for transmitting alarm signals to the central station by means of radio signals encoding binary data words, each of sid remote stations including a plurality of alarm sensors for detecting the occurrence of a respective one of a plurality of alarm conditions at the remote station, each of said data words including a first plurality of bits identifying the remote station originating it, a second plurality of bits identifying an alarm condition occurring at that remote station, and a frame pulse, remote station apparatus comprising:

alarm sensor sequencing means responsive to any of said alarm sensors indicating the occurrence of an alarm condition for cyclically selecting each of said alarm sensors in turn and for producing a plurality of binary coded output signals identifying the selected alarm sensor;

data storage means for storing a plurality of bits identifying said remote station;

a first clock for producing an output signal having timing pulses at predetermined regular intervals;

gate means responsive to the output signal of said first clock for passing said timing pulses when enabled and for inhibiting said timing pulses when not enabled;

a first counter for counting the timing pulses produced by said first clock which are not passed by said gate means;

data sequencing means for cyclically selecting each of the bits stored by said data storage means and each of the binary signals produced by said alarm sensor sequencing means in turn and for producing a frame pulse initiating output signal intermediate the selection of a predetermined two of said bits and binary signals, said data sequencing means advancing in response to each timing pulse passed by said gate means;

gate control means responsive to said data sequencing means and to said first counter for enabling said gate means when the bit or binary signal selected by said data sequencing means has a first binary value, for inhibiting said gate means until one timing pulse is counted by said first counter when the bit or binary signal selected by said data sequencing means has a second binary value, and for inhibiting said gate means until two timing pulses are counted by said first counter when a frame pulse initiating output signal is being produced; and radio transmitter means responsive to said alarm sensor sequencing means for transmitting a radio output signal representative of the output signal of said gate means when said alarm sensor sequencing means selects an alarm sensor indicating the occurrence of an alarm condition.

2. The apparatus defined in claim 1 wherein said alarm sensor sequencing means comprises:

a second clock for producing an output signal having timing pulses at intervals substantially longer than the intervals between the timing pulses produced by said first clock;

a second counter for counting the timing pulses produced by said second clock and producing a plurality of binary coded output signals indicative of the count registered by said second counter;

alarm sensor selector means responsive to the output signals of said second counter for producing an output signal indicative of whether the alarm sensor associated with the count registered by said second counter has detected the occurrence of an alarm condition;

a third counter responsive to said second counter for counting the number of cycles of said second counter and for producing a plurality of binary output signals indicative of the count registered by said third counter;

means responsive to a relatively low valued output signal of said third counter for inhibiting said radio transmitter means when the count registered by said third counter includes said relatively low valued component; and means responsive to the output signals of said third counter for resetting all of said alarm sensors when the count registered by said third counter reaches a predetermined value in excess of said relatively low valued component.

3. The apparatus defined in claim 1 wherein said radio signal is frequency modulated and wherein said radio transmitter means comprises:

an oscillator having a characteristic radio frequency; and frequency shift modulator means responsive to the output signal of said gate means for shifting the frequency of said oscillator by a predetermined amount when a timing pulse occurs in the output signal of said gate means.

4. The apparatus defined in claim 1 further comprising timing means responsive to said radio transmitter means for timing the operation of said radio transmitter means and for disabling the remote station if the period of operation of said radio transmitter means exceeds the longest normal period of uninterrupted transmitter operation.

5. The apparatus defined in claim 1 wherein at least one of the bits stored by said data storage means represents the code number of a central station which is to respond to alarm signals transmitted by the remote station.

6. A central station for use in a radio central station alarm system for receiving alarm signals from a plurality of remote stations by means of radio signals encoding repetitive binary data words, each of said data words including a predetermined number of bits of information each including a timing signal, a bit having a first binary value being represented by a timing signal occurring a first predetermined time interval after the preceding timing signal and a bit having a second binary value being represented by a timing signal occurring a second longer time interval after the preceding timing signal, said data words being separated from one another by a frame pulse represented by a timing signal occurring a third still longer time interval after the preceding timing signal, comprising:

radio receiver means for receiving said radio signals and for producing a first data output signal including timing pulses corresponding to the timing signals in the received radio signals;

a shift register having a plurality of output terminals for applying an output signal to successive output terminals as said shift register is shifted;

means for shifting said shift register at a predetermined rate;

first means responsive to the occurrence of a timing pulse in said first data signal for producing a second data output signal having a first binary value if said shift register is applying an output signal to a first output terminal when said timing pulse occurs and having a second binary value if said shift register is applying an output signal to a second output terminal when said timing pulse occurs and for subsequently presetting said shift register;

means for storing said second data output signal as one of the successive bits in a data word being received;

means for counting the timing pulses in said first data output signal;

second means responsive to the occurrence of a timing pulse in said first data output signal for producing an output signal indicating that a frame pulse has been received if said shift register is applying an output signal to a third output terminal when said timing pulse occurs and for subsequently presetting said shift register;

means responsive to the output signal of said second means for producing a control transfer output signal if the number of pulses registered by said means for counting equals said predetermined number and for subsequently resetting said means for counting; and means responsive to said control transfer output signal for producing an alarm output indication corresponding to the data word stored in said means for storing.

7. The apparatus defined in claim 6 wherein said shift register applies said output signal to said first, second, and third output terminals, respectively, said first, second, and third time intervals after being preset.

8. The apparatus defined in claim 7 wherein said shift register applies said output signal to at least one further output terminal after being preset and before applying said output signal to said first output terminal and wherein said central station further comprises:

signal blanking means for preventing the apparatus from responding to a timing pulse occurring in said first data output signal while said shift register is applying an output signal to said further output terminal.

9. The apparatus defined in claim 7 wherein said shift register includes at least one further output terminal intermediate said first and second and second and third output terminals and wherein said central station further comprises:

signal blanking means for preventing the apparatus from responding to a timing pulse occurring in said first data output signal while said shift register is applying an output signal to any of said further output terminals.

10. The apparatus defined in claim 7 wherein said shift register applies said output signal to at least one further output terminal after applying said output signal to said third output terminal unless preset by said second means and wherein said central station further comprises:

error detection means for preventing said means for producing a control transfer output signal from producing said control transfer output signal when said shift register applies an output signal to said further output terminal; and means responsive to the output signal of said second means for resetting said error detection means substantially concurrently with the resetting of said means for counting.

11. The apparatus defined in claim 10 wherein said means for storing comprises a data storage shift register capable of storing said predetermined number of bits and wherein said control transfer output signal is produced only after two successive identical data words have been received, said central station further comprising:

comparator means for comparing said second data output signal with the oldest bit currently stored in said data storage shift register and for setting said error detecting means if the information represented by said second data output signal is different from said oldest bit; and means for shifting said data storage shift register to discard said oldest bit and store said second data output signal as a newest bit subsequent to operation of said comparator means.

12. The apparatus defined in claim 10 wherein each of said data words includes at least one bit at a predetermined location representing the code number of the receiver which is to produce alarm output indications corresponding to said data word and wherein said means for storing comprises a data storage register capable of storing said predetermined number of bits and producing an output signal representing the bit stored at said predetermined location, said central station further comprising:

means for producing an output signal representing the code number of said central station;

means for comparing said output signal of said data storage register with said output signal representing the code number of said central station and for preventing said means for producing a control transfer output signal from producing said control transfer output signal if said output signal of said data storage register does not correspond to the code number of said central station.

13. The apparatus defined in claim 6 wherein said means responsive to said control transfer output signal comprises:

a memory for storing a plurality of previously received data words;

means for selectively decoding and displaying the data words stored in said memory; and means for comparing the data word stored in said means for storing with each of the previously received data words stored in said memory and for storing said data word in a location in said memory if said data word is not already stored in said memory.

14. The apparatus defined in claim 13 wherein said means responsive to said control transfer output signal further comprises:

means permitting an operator of the central station to acknowledge a data word displayed by said means for decoding and displaying; and means for clearing the memory location storing the acknowledged data word.

15. A radio central station alarm system including a central station and a plurality of remote stations for transmitting alarm signals to the central station by means of radio signals encoding repetitive data words, each of said remote stations including a plurality of alarm sensors for detecting the occurrence of a respective one of a plurality of alarm conditions at the remote station, each of said data words including a first plurality of bits identifying the remote station originating it, a second plurality of bits identifying an alarm condition occurring at that remote station, and a frame pulse, each of said bits and frame pulses including a timing pulse, a bit having a first binary value being represented by a timing signal occurring a first predetermined time interval after the preceding timing signal, a bit having a second binary value being represented by a timing signal occurring a second longer time interval after the preceding timing signal, and a frame pulse being represented by a timing signal occurring a third still longer time interval after the preceding timing signal, comprising:

remote station apparatus including:

alarm sensor sequencing means responsive to any of said alarm sensors indicating the occurrence of an alarm condition for cyclically selecting each of said alarm sensors in turn and for producing a plurality of binary coded output signals identifying the selected alarm sensor;

data storage means for storing a plurality of bits identifying said remote station;

a first clock for producing timing signals at predetermined regular intervals;

gate means responsive to the output signal of said first clock for passing said timing signals when enabled and for inhibiting said timing signals when not enabled;

a first counter for counting the timing signals produced by sid first clock which are not passed by said gate means;

data sequencing means for cyclically selecting each of the bits stored by said data storage means and each of the binary signals produced by said alarm sensor sequencing means in turn and for producing a frame pulse initiating output signal intermediate the selection of a predetermined two of said bits and binary signals, said data sequencing means advancing in response to each timing signal passed by said gate means;

gate control means responsive to said data sequencing means and to said first counter for enabling said gate means when the bit or binary signal selected by said data sequencing means has a first binary value, for inhibiting said gate means until one timing signal is counted by said first counter when the bit or binary signal selected by said data sequencing means has a second binary value, and for inhibiting said gate means until two timing signals are counted by said first counter when a frame pulse initiating output signal is being produced; and radio transmitter means responsive to said alarm sensor sequencing means for transmitting a radio output signal representative of the output signal of said gate means when said alarm sensor sequencing means selects an alarm sensor indicating the occurrence of an alarm condition; and central station apparatus including:

radio receiver means for receiving said radio output signal and for producing a first data output signal including timing pulses corresponding to the timing signals in the received radio signal;

a shift register having a plurality of output terminals for applying an output signal to successive output terminals as said shift register is shifted;

means for shifting said shift register at a predetermined rate;

first means responsive to the occurrence of a timing pulse in said first data signal for producing a second data output signal having a first binary value if said shift register is applying an output signal to a first output terminal when said timing pulse occurs and having a second binary value if said shift register is applying an output signal to a second output terminal when said timing pulse occurs and for subsequently presetting said shift register;

means for storing said second data output signal as one of the successive bits in a data word being received;

means for counting the timing pulses in said first data output signal;

second means responsive to the occurrence of a timing pulse in said first data output signal for producing an output signal indicating that a frame pulse has been received if said shift register is applying an output signal to a third output terminal when said timing pulse occurs and for subsequently presetting said shift register;

means responsive to the output signal of said second means for producing a control transfer output signal if the number of pulses registered by said means for counting equals said predetermined number and for subsequently resetting said means for counting; and means responsive to said control transfer output signal for producing an alarm output indication corresponding to the data word stored in said means for storing.

* * * * *

UNITED STATES PATENT AND TRADEMARK OFFICE

CERTIFICATE OF CORRECTION

PATENT NO. : 4,020,477

DATED : April 26, 1977

INVENTOR(S) : John M. Holland

It is certified that error appears in the above-identified patent and that said Letters Patent are hereby corrected as shown below:

| Column | Line | |
|---|---|---|
| 1 | 9 | delete "connected" |
| 1 | 60 | "identify" should be --identity-- |
| 2 | 23 | "," should be --.-- |
| 5 | 43 | "for" should be --of-- |
| 5 | 45 | after "repeated" insert --.-- |
| 6 | 60 | after "logical" (2nd occurrence) delete "," |
| 7 | 10 | "varialbe" should be --variable-- |
| 8 | 11 | after "variable" delete "-" |
| 9 | 6 | after "transmitter" delete "," |
| 9 | 7 | "of" (1st occurrence) should be --the-- |
| 10 | 11 | "ores" should be --ones-- |
| 10 | 12 | "9" should be --0-- |
| 10 | 50 | before "binary" insert --A-- |
| 10 | 53 | "443" should be --43-- |
| 11 | 28 | "in" should be --is-- |

UNITED STATES PATENT AND TRADEMARK OFFICE

CERTIFICATE OF CORRECTION

PATENT NO. : 4,020,477

DATED : April 26, 1977

INVENTOR(S) : John M. Holland

It is certified that error appears in the above-identified patent and that said Letters Patent are hereby corrected as shown below:

| Column | Line | |
|---|---|---|
| 12 | 10 | "passes" should be --passed-- |
| 12 | 34 | "ic" should be --is-- |
| 13 | 18 | after "in" insert --the-- |
| 14 | 29 | "latchs" should be --latches-- |
| 15 | 3 | "when" should be --When-- |
| 16 | 31 | "nad" should be --and-- |
| 16 | 33 | "form" should be --from-- |
| 16 | 34 | before "power" insert --In a short time fuse 11 burns out, thereby cutting off all-- |
| 16 | 36 | after "one" insert --of-- |
| 16 | 59 | "probablility" should be --probability-- |
| 16 | 60 | "ohter" should be --other-- |
| 16 | 63 | "Twosuccessive" should be --Two successive-- |
| 16 | 64 | "ward" should be --word-- |
| 18 | 35 | "Q1" should be --$\overline{Q1}$-- |
| 18 | 40 | "Q3" should be --$\overline{Q3}$-- |

UNITED STATES PATENT AND TRADEMARK OFFICE

CERTIFICATE OF CORRECTION

PATENT NO. : 4,020,477

DATED : April 26, 1977

INVENTOR(S) : John M. Holland

It is certified that error appears in the above-identified patent and that said Letters Patent are hereby corrected as shown below:

| Column | Line | |
|---|---|---|
| 20 | 34 | "even" should be --every-- |
| 22 | 17 | after "last" insert --data-- |
| 22 | 19 | after "last" insert --data-- |
| 22 | 66 | "and" (1st occurrence) should be --or-- |
| 23 | 22 | "locgical" should be --logical-- |
| 25 | 60 | "connceted" should be --connected-- |
| 27 | 26 | "sid" should be --said-- |
| 31 | 48 | "sid" should be --said-- |

Signed and Sealed this

*nineteenth* Day of *July 1977*

[SEAL]

*Attest:*

RUTH C. MASON
*Attesting Officer*

C. MARSHALL DANN
*Commissioner of Patents and Trademarks*